US009726429B1

(12) United States Patent
Jamaluddin et al.

(10) Patent No.: US 9,726,429 B1
(45) Date of Patent: Aug. 8, 2017

(54) WOOD PROCESSING OVEN AND METHOD

(71) Applicant: EPCON Industrial Systems, LP, Conroe, TX (US)

(72) Inventors: Aziz A. Jamaluddin, The Woodlands, TX (US); Nedzad Hadzajlic, The Woodlands, TX (US)

(73) Assignee: EPCON Industrial Systems, LP, Conroe, TX (US)

( * ) Notice: Subject to any disclaimer, the term of this patent is extended or adjusted under 35 U.S.C. 154(b) by 0 days.

(21) Appl. No.: 15/057,831

(22) Filed: Mar. 1, 2016

Related U.S. Application Data

(60) Provisional application No. 62/289,299, filed on Jan. 31, 2016.

(51) Int. Cl.
*F26B 25/22* (2006.01)
*F26B 23/02* (2006.01)
*F26B 25/00* (2006.01)

(52) U.S. Cl.
CPC ..... *F26B 25/22* (2013.01); *F26B 23/02* (2013.01); *F26B 25/002* (2013.01)

(58) Field of Classification Search
CPC ..... F26B 25/22; F26B 23/02; F26B 25/002
USPC ..... 34/396, 446
See application file for complete search history.

(56) References Cited

U.S. PATENT DOCUMENTS

RE15,316 E * 3/1922 Weiss ..... B27K 5/0085 34/396
1,593,598 A * 7/1926 Redman ..... F26B 9/06 34/225
2,270,815 A 1/1942 Vaughan
2,463,782 A * 3/1949 Leischner ..... F26B 3/20 165/61
3,470,623 A * 10/1969 Hildebrand ..... F26B 15/00 34/210

(Continued)

FOREIGN PATENT DOCUMENTS

EP 0589113 A1 3/1994
EP 1570710 B1 5/2006
WO WO 0053985 A1 * 9/2000 ..... F26B 21/02

OTHER PUBLICATIONS

Airex Industries; Biomasse Torrefaction Oven informatin sheet; 4 pages; no month, 2009; Airex Industries; Quebec, CA.

(Continued)

*Primary Examiner* — Stephen M Gravini
(74) *Attorney, Agent, or Firm* — Jeffrey L. Wendt; The Wendt Firm, P.C.

(57) ABSTRACT

Systems and methods for treating wood and wood products, including a structure defining a wood treating zone, an air heating zone, a heated air supply zone, and a cooled air return zone. Heating units feed conduits defining one or more heat transfer surfaces and an indirect heat exchange substructure. The heated air supply zone includes left and right heated air plenums, and the cooled air return zone includes a return duct, all internal of the wood treating zone. A movable cart moves spaced apart, stacked wood products into and out of the wood heating zone. The cart and wood thereon fit closely within but do not touch the wood treating zone. An air blower internal of the heated air supply zone and in fluid communication with the air heating zone and the heated air supply zone recirculates air. An exhaust blower vents some of the cooled air.

27 Claims, 11 Drawing Sheets

(56) References Cited

U.S. PATENT DOCUMENTS 4,017,980 A * 4/1977 Kleinguenther ..... F26B 7/00 100/38
4,182,048 A * 1/1980 Wolfe ..... F26B 3/04 34/396
4,240,787 A 12/1980 Jamaluddin
4,242,084 A 12/1980 Jamaluddin
4,261,110 A * 4/1981 Northway ..... F26B 25/001 34/216
4,322,203 A 3/1982 Jamaluddin
5,276,980 A * 1/1994 Carter ..... F26B 21/026 34/191
5,678,324 A * 10/1997 Viitaniemi ..... F26B 3/02 34/396
5,704,134 A * 1/1998 Carter ..... F26B 25/185 211/59.4
5,836,086 A * 11/1998 Elder ..... F26B 3/04 34/396
5,899,004 A * 5/1999 Sugaoka ..... B27K 3/0271 34/396
5,940,984 A * 8/1999 Moren ..... F26B 21/06 34/396
5,979,074 A * 11/1999 Brunner ..... F26B 21/022 34/396
6,135,765 A 10/2000 Jamaluddin
6,149,707 A 11/2000 Jamaluddin
7,383,642 B1 * 6/2008 Maya ..... B27K 3/0271 34/396
7,748,137 B2 * 7/2010 Wang ..... A01G 9/22 144/364
7,963,048 B2 * 6/2011 Pollard ..... F26B 15/12 110/315
7,987,614 B2 * 8/2011 Erickson ..... F26B 7/00 100/50
8,046,932 B2 * 11/2011 Wolowiecki ..... F26B 13/10 34/212
8,857,074 B2 * 10/2014 Bernon ..... B27K 3/02 110/216
8,875,414 B2 * 11/2014 Blomquist ..... F26B 3/04 104/172.3
8,881,425 B2 11/2014 Latos
9,200,834 B1 * 12/2015 Ball, Jr. ..... F26B 25/063
2003/0115771 A1 * 6/2003 Ishii ..... F26B 21/10 34/396
2015/0345865 A1 * 12/2015 Rivera ..... B65G 39/18 198/572

OTHER PUBLICATIONS

Maxon; Tube-O-therm Low Temperature Gas Burners information sheet; 6 pages; no month, 2012; Maxon Corporation; Muncie, IN; US.

Nyle Systems; Dehumidification Lubmer Drying brochure; 73 pages; Apr. 11, 2011; Bangor, ME; US.

* cited by examiner

WOOD PROCESSING OVEN AND METHOD

BACKGROUND INFORMATION

Technical Field

The present disclosure relates generally to the field of wood treatment apparatus, and methods of use, and more specifically to wood and wood composite heat treatment systems, and methods of their use, particularly for heat treating such materials used for furniture and flooring.

Background Art

Typically natural wood or composite materials either have chemicals applied or are intrinsically moisture-laden (either so-called "free" moisture or "fiber" moisture, or both). Wood for furniture making and wood used for flooring may be subjected to one or more of various processes, including curing, kiln-drying, conditioning, and the like, first to cure the chemicals and drive out volatiles and naturally existing moisture. Because of the combustibility of wood, major challenges are presented to design an oven for moisture processing.

Various types of ovens and methods are used for drying plywood, laminated wood or natural wood, all generally comprising a box or container defining a treatment zone, and including exhaust fans, heating means such as burners for direct heating of circulating air, use of stickers for spacing the boards, and air circulation fans. Some systems and methods include movable supports for the wood, for example carts or actual rail cars movable upon rails. Some ovens include grills or fins on inlet and/or outlet of air blowers to convert turbulent flows into laminar flows, or use of panels with spoilers with certain shape. One technique consists in using the energy available in a large wood products plant, such as a steam boiler, to supply steam to tubes internal of or external of the treating oven, where air is blown around the tubes to heat the air, and then through a stack of wood products in a cross-circulation flow pattern. In some techniques and ovens, or entire warehouses, the cross-circulation flow direction may be reversed periodically. In other techniques, the floor or supporting panels for the wood are heated by steam tubes or electrical wires. In yet other techniques, microwaves may be used to treat the wood (kill insects) and heat the wood.

As noted herein, the predominant technique is to employ direct-heated air in cross-circulation flow of the air through separated wood pieces, such as boards or panels separated by stickers, where flow direction is periodically reversed. While fairly efficient for creating wood boards or panels of homogenous moisture quantity, this technique either requires manual switching of flow direction, which would be counterproductive or even hazardous if left un-switched, or complicated, expensive controllers and algorithms based on moisture sensors, temperature sensors, and the like. This limits the applicability of the technique to a limited number of operations where the same species of wood is processed every time, and therefore operation may be based on known or only slightly varying moisture levels in the feedstock. Another drawback of this technique (according to the known art) is that the combustion products from combustion burners flowing in the circulating air may have a deleterious effect on the wood, depending on the fuel and oxidant used, which would also be counterproductive.

It would be an advanced in the wood treatment art, and in particular the art of combustion-based heat treating and/or moisture treating of wood and wood products, to improve energy usage and/or safety while avoiding direct contact of the combustion products with the product being treated.

SUMMARY

In accordance with the present disclosure, apparatus, systems (ovens) and methods of treating wood products using the apparatus and systems are described that may reduce or eliminate problems with known apparatus, systems, and methods.

One aspect of the disclosure is a method comprising (or consisting of, or consisting essentially of):

(a) loading a batch of wood or lumber into a wood treating zone of a structure having a longitudinal axis, the structure defining the wood treating zone, an air heating zone, a heated air supply zone, and a cooled air return zone, the wood treating zone fluidly connected to the heated air supply zone and the cooled air return zone, and the air heating zone fluidly connected to the cooled air return zone and the heated air supply zone, the batch of wood or lumber comprising a stack of a plurality of rows of horizontal wood members, each row comprising top and bottom metal plates sandwiching at least one wood member there between, each row separated from adjacent rows by respective air gaps;

(b) forming an indirectly heated air stream by indirectly exchanging heat in the air heating zone from hot air or hot combustion products to a combined cooled air stream flowing through the air heating zone by contacting the hot air or hot combustion products with one side of one or more heat transfer surfaces with the cooled air stream contacting part or all of opposite sides of the one or more heat transfer surfaces;

(c) splitting the indirectly heated air stream into right-side and a left-side indirectly heated air streams;

(d) flowing the right-side indirectly heated air stream into a right plenum, and flowing the left-side indirectly heated air stream into a left plenum, the right and left plenums positioned aside respective right and left sides of the stack in the heated air supply zone;

(e) flowing the right-side and left-side indirectly heated air streams from their respective plenums generally horizontally between the rows in the wood treating zone, the respective indirectly heated air streams flowing into the air gaps simultaneously from right and left plenums causing turbulence in the air gaps, and then exiting to forward and rear of the wood treatment zone and forming front and rear cooled air streams; and (f) collecting a major portion of the front and rear cooled air streams above the stack in a return duct of the cooled air return zone forming the combined cooled air stream, and flowing the combined cooled air stream to the air heating zone.

In certain method embodiments the indirectly exchanging heat in the air heating zone comprises (or consists essentially of, or consists of) hot combustion products from one or more combustion burners flowing through one or more heated tubular members to a combined cooled air stream flowing through the air heating zone, the hot combustion products formed by combusting one or more fuels with one or more oxidants in the one or more combustion burners attached to the structure externally of the air heating zone, one or more burner exhaust conduits fluidly connected at a first end to the one or more combustion burners and at a second end to a roof of the structure, the one or more exhaust conduits defining the heated tubular members arranged in an indirect heat exchange substructure in the air heating zone.

In certain method embodiments the cooled air is heated to a temperature ranging from about 150° F. to about 800° F. (66° C. to about 427° C.), more preferably ranging from about 500° F. to about 700° F. (260° C. to about 371° C.), more preferably from 600° F. to 680° F. (316° C. to 360° C.), or from 620 to 670° F. (327° C. to 354° C.), or from 640° F. to 660° F. (338° C. to 349° C.).

In certain method embodiments the loading may comprise, consist essentially of, or consist of moving a removable cart or carriage loaded with the stack of wood or lumber into the wood treating zone, the removable cart or carriage and load of wood thereon closely fitting within the wood treating zone but not touching the left and right plenums or the return duct.

Certain method embodiments may comprise exhausting a minor portion of the combined cooled air stream from the cooled air return zone.

In certain method embodiments the directing of the combined cooled air stream past the one or more heated tubular members in the air heating zone comprises flowing the combined cooled air stream in cross-flow pattern across outer surfaces of the heated tubular members.

In certain method embodiments the combined cooled air stream may flow generally downward while passing across the outer surfaces of the heated tubular members.

In certain method embodiments the fuel may be selected from the group consisting of methane, gaseous natural gas, liquefied natural gas, propane, butane, hydrogen, steam-reformed natural gas, atomized hydrocarbon oil, combustible powders, flowable solids, waste materials, slurries, and mixtures or other combinations thereof, and the oxidant may be selected from the group consisting of air, gases having the same molar concentration of oxygen as air, oxygen-enriched air having 50 mole percent or more oxygen, industrial grade oxygen, food grade oxygen, and cryogenic oxygen.

Certain method embodiments may comprise, or consist essentially of, or consist of controlling moisture removal from the wood or lumber by one or more control methods selected from the group consisting of monitoring humidity (or relative humidity, "RH") of the left, right, or combined cooled air stream, monitoring humidity (or RH) of the indirectly heated air stream, monitoring one or more temperatures of the left, right, or combined cooled air steams and/or heated air streams, and combinations thereof. In certain methods the wood or lumber may be selected from the group consisting of natural woods, composites, and laminates, wherein the natural wood may be selected from the group consisting of pine, spruce, hardwoods, and sustainable wood species. In certain methods, the laminate may be a wood flooring laminate.

Another aspect of the disclosure is a system (sometimes referred to herein as an "oven" or "oven system") comprising (or consisting essentially of, or consisting of):

(a) a structure having a longitudinal axis, the structure defining a wood treating zone, an air heating zone, a heated air supply zone, and a cooled air return zone;

(b) one or more heating units (preferably one or more combustion burners) attached to the structure externally of the air heating zone;

(c) one or more conduits (preferably burner exhaust conduits) fluidly connected at a first end to the one or more heating units and at a second end to a roof of the structure, the one or more conduits defining one or more heat transfer surfaces (preferably one or more heated tubular members) and an indirect heat exchange substructure in the air heating zone;

(d) the heated air supply zone comprising left and right heated air plenums, and the cooled air return zone comprising a return duct, the plenums and return duct internal of the wood treating zone;

(e) a movable cart or carriage configured for moving spaced apart stacked wood products to be treated into and out of the wood heating zone, the removable cart or carriage and, when loaded, load of wood thereon closely fitting within the wood treating zone but not touching the left and right plenums or the return duct; and (f) at least one recirculating air blower internal of the heated air supply zone and in fluid communication with the air heating zone and the heated air supply zone, and at least one exhaust blower in fluid communication with the cooled air return zone.

In certain system embodiments the wood treating zone is fluidly connected to the heated air supply zone and the cooled air return zone, and the air heating zone is fluidly connected to the cooled air return zone and the heated air supply zone, wherein the wood treating zone is fluidly connected to the heated air supply zone and the cooled air return zone, and the air heating zone is fluidly connected to the cooled air return zone and the heated air supply zone, the spaced apart stacked wood products comprising a stack of a plurality of rows of horizontal wood members, each row comprising top and bottom metal plates sandwiching at least one wood member there between, each row separated from adjacent rows by respective air gaps.

In certain system embodiments the left and right heated air plenums may be configured vertically and co-extensively with the respective left and right edges of the stack of wood, and parallel to the longitudinal axis of the structure, each plenum having a constant cross-sectional area, each plenum fluidly connected to respective left and right outlet ducts of a single recirculating air blower, the left and right outlet ducts each having a cross-sectional area greater than the cross-sectional area of the plenums. In certain system embodiments the left and right heated air plenums may comprise a plurality of vertical sheet metal panels and a plurality of vertical sheet metal nozzles adjustably attached between respective vertical sheet metal panels using a plurality of threaded members (screws or bolts), the vertical nozzles adjustable in forward and rear directions depending on adjustment in and out of the plurality of threaded members.

In certain system embodiments the one or more combustion burners may be attached to the structure externally of the air heating zone and may comprise a right-side burner and a left-side burner attached respectively to opposing left and right walls of the structure, attached in this sense meaning attached directly to the walls of the structure, with no intervening structure or conduit other than possibly a support bracket, platform or the like. In certain system embodiments the combustion burners may be nozzle-mix, gas fired, refractory-less burners.

In certain system embodiments the exhaust conduits defining the tubular members of the indirect heat exchange substructure in the air heating zone may be arranged at angles ranging from 0 to 45 degrees to horizontal (preferably horizontally) in a cross-flow pattern, the tubular members fluidly connected by U-shaped return members. In certain system embodiments the heat exchange substructure may comprise one or more structures (baffles, distributor plates, grids, and the like) for causing a tortuous flow path for the cooled air stream around the tubular members of the indirect heat exchange substructure.

Another aspect of the disclosure is a movable cart or "compression skid" for moving spaced apart stacked wood products to be treated into and out of a wood heating zone of a structure, the removable cart or carriage configured to closely fitting within the wood treating zone but not touching structure of the wood treating zone, the movable cart or carriage comprising (or consisting of, or consisting essentially of):

(a) a frame comprising a (preferably rectangular) floor, four vertical corner supports attached at their lower end to respective corners of the floor and extending upward and connecting at their upper ends to frame cross members;

(b) a stack of a plurality of rows adapted to hold a plurality of horizontal wood members, each row comprising top and bottom metal plates sandwiching at least one wood member there between, each row separated from adjacent rows by respective air gaps, the rows connected on their periphery by rods and nuts allowing the top metal plate of each row to be lifted and separated from the bottom metal plate, allowing loading of the cart;

(c) a plurality of tubular members adapted to separate the rows and define a plurality of separate levels for the wood panels, the tubular members movable with respect to each other in a vertical direction as the top plate of each row is lifted and dropped during cart loading, and when the wood panels lose or gain moisture during heat treatment;

(d) one or more winches attached to the cart or carriage frame and to one or more sets of the tubular members, the one or more winches adapted to compress the frame vertically as the wood panels lose moisture, or loosen the frame as the wood panels gain moisture.

In certain system embodiments the movable cart or carriage may comprise a set of frame support members selected from the group consisting of wheels, rollers, bearings, skates (for example when used on ice), and sets of magnets for magnetic levitation. The wheels, rollers, or bearings may be configured to interact with corresponding rails.

Systems for treating wood comprising the movable cart or carriage are another aspect of the disclosure. Other system, apparatus, and method embodiments, such as methods of producing treated laminate wood products, and wood products made by any of the methods of this disclosure are considered aspects of this disclosure.

Systems, apparatus, products, and methods of the disclosure will become more apparent upon review of the brief description of the drawings, the detailed description of the disclosure, and the claims that follow.

BRIEF DESCRIPTION OF THE DRAWINGS

The manner in which the objectives of the disclosure and other desirable characteristics can be obtained is explained in the following description and attached drawings in which.

Figure 1:
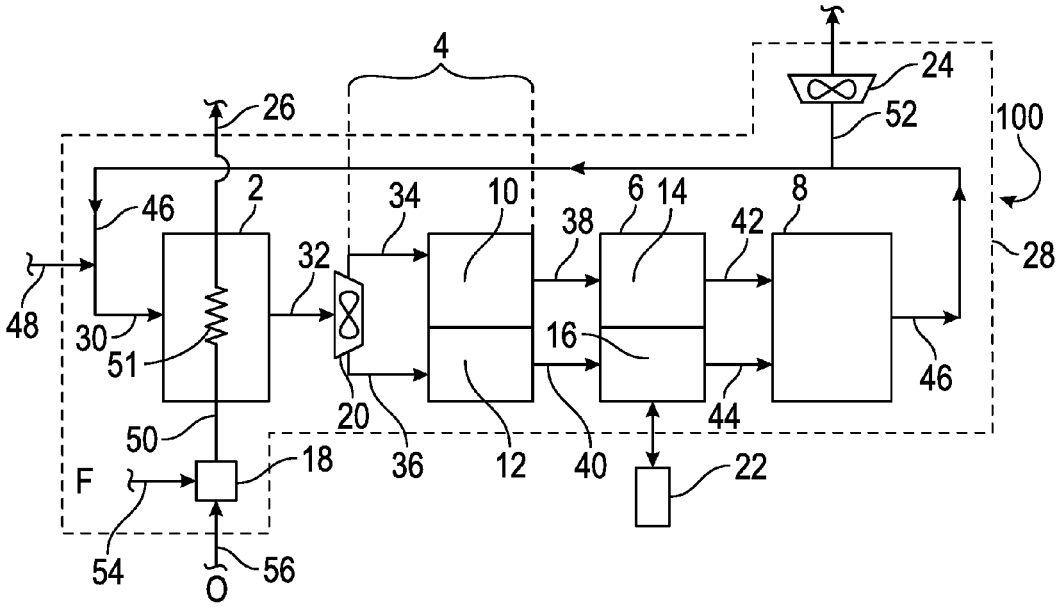
FIGS. 1 and 2 are schematic process flow diagrams of two methods, systems, and apparatus embodiments in accordance with the present disclosure.

It is to be noted, however, that the appended drawings are schematic in nature, may not be to scale (in particular FIGS. 3-16), and illustrate only typical embodiments of this disclosure and are therefore not to be considered limiting of its scope, for the disclosure may admit to other equally effective embodiments.

DETAILED DESCRIPTION

In the following description, numerous details are set forth to provide an understanding of the disclosed systems, apparatus, and methods. However, it will be understood by those skilled in the art that the systems, apparatus, and methods covered by the claims may be practiced without these details and that numerous variations or modifications from the specifically described embodiments may be possible and are deemed within the claims. For example, wherever the term "comprising" is used, other embodiments and/or components and/or steps where "consisting essentially of" and "consisting of" may be substituted for "comprising" are explicitly disclosed herein and are part of this disclosure. All published patent applications and patents referenced herein are hereby explicitly incorporated herein by reference. In the event definitions of terms in the referenced patents and applications conflict with how those terms are defined in the present application, the definitions for those terms that are provided in the present application shall be deemed controlling.

As explained briefly in the Background, the predominant technique is to employ direct-heated air in cross-circulation flow of the air through separated wood pieces, such as boards or panels separated by stickers, where flow direction is periodically reversed. While fairly efficient for creating wood boards or panels of homogenous moisture quantity, this technique either requires manual switching of flow direction, which would be counterproductive or even hazardous if left un-switched, or complicated, expensive controllers and algorithms based on moisture sensors, temperature sensors, and the like. This limits the applicability of the technique to a limited number of operations where the same species of wood is processed every time, and therefore operation may be based on known or only slightly varying moisture levels in the feedstock. Another drawback of this technique (according to the known art) is that the combustion products from combustion burners flowing in the circulating air may have a deleterious effect on the wood, depending on the fuel and oxidant used, which would also be counterproductive.

It would be an advanced in the wood treatment art, and in particular the art of combustion-based heat treating and/or moisture treating of wood and wood products, to improve energy usage and/or safety while avoiding direct contact of the combustion products with the product being treated.

Another advance would be to modify the air flow within the oven and/or design of the cart or carriage to achieve one or more of these goals. The present application is devoted to resolving one or more of these challenges In certain embodiments, Epcon®, the assignee of the present disclosure and inventions described herein, developed a unique oven for a special product for moisture drying and curing system. This is a batch or semi-batch oven, in conjunction with a specially designed cart, which holds flat materials (for example laminated flooring material). Typically, laminate has a thickness ranging from 0.5 to 0.75 inch (1.3 to 1.9 centimeter), and 4 feet by 8 feet (1.2 by 2.4 meter) moisture-laden sheets that are stacked up as shown in some of the appended schematic figures. In certain embodiments, the oven operates at about 650° F. (about 343° C.) and the air is indirectly heated, supplied by an indirect heating system.

The ovens of the present disclosure are very uniquely designed (despite the fact that in certain embodiments they may be constructed from commonly available components, such as burners, blowers, and standard designed oven panels (walls)) to provide a specific airflow pattern about wood stacked on a cart specially designed to be used with the oven. In a very generally sense, the ovens of the present disclosure comprise at least two distinct zones: an air heating zone, and a wood heating zone. The cart itself and wood stacked thereon in part define the airflow pattern in the wood heating zone. The ovens of the present disclosure include a source or sources of indirectly heated air, the indirectly heated air devoid of combustion gases, from an indirect air heating zone of the oven, to left and right internal heated air plenums, and then from the plenums simultaneously from both "right" and "left" lateral directions with upward movement, the heated air entering the wood heating zone of the oven from both directions, the air being cooled while contacting the wood, the cooled air collecting at the top of the wood treatment zone of the oven, and returning to an indirect heat exchanger positioned within the air heating zone heat via the gap (duct) between the inner surface of the top of the oven and the top layer of the wood product. One or more recirculation blowers and one or more exhaust blowers may be used to control airflow, providing positive and negative pressure where needed in the oven. This is a batch type oven provided with two indirect fired heat exchangers, both sides hot air supplied plenums with specially arranged nozzles and uniquely designed cart which holds the processed wood. The oven is very unique due to the combustibility of the wood presenting major challenge to design this oven. The oven design provide capability to heat the wood (which is sandwiched between the plates on the carts) in the oven to 650° F. or higher and change the composition of wood making it much stronger and more durable comparing to natural wood, plastic or any new deck material but still keeping natural look of the wood present.

Various terms are used throughout this disclosure. "Indirect heating" as used herein means that hot air or combustion gases emanate from combustion burners or combustion burner panels, or other heat sources (Joule electric coils) and then contract, preferably in a flowing fashion to increase heat transfer, one or more heat transfer surfaces positioned between that hot air or combustion gases and the cooled air as described herein. The burners or burner panels or electric heating coils may be floor-mounted, wall-mounted (including end walls and/or side walls), or any combination thereof (for example, two side wall-mounted burners and one end wall mounted burner panel or electric heater). Burner panels may form part of an oven floor and/or wall structure. A "burner panel" is simply a panel equipped to emit fuel and oxidant, or in some embodiments only one of these (for example a burner panel may only emit fuel, while another burner panel emits only oxidant, and vice versa). A "plenum" is a space in which a gas, usually air, is contained at a pressure greater than atmospheric pressure.

As used herein the phrase "combustion gases" as used herein means substantially gaseous mixtures comprised primarily of combustion products, such as oxides of carbon (such as carbon monoxide, carbon dioxide), oxides of nitrogen, oxides of sulfur, and water, as well as partially combusted fuel, non-combusted fuel, and any excess oxidant. Combustion products may include liquids and solids, for example soot and unburned liquid fuels. "Exhaust", "burner exhaust", and "burner flue gas" are equivalent terms and refer to a combination of combustion gases and other effluent from combustion burners, such as adsorbed water, water of hydration, $CO_2$ and $H_2O$ liberated from combustion of hydrocarbons, and the like. Therefore exhaust may comprise oxygen or other oxidants, nitrogen, combustion products (including but not limited to, carbon dioxide, carbon monoxide, $NO_x$, $SO_x$, $H_2S$, and water) and uncombusted fuel.

"Oxidant" as used herein includes air, gases having the same molar concentration of oxygen as air (for example "synthetic air"), oxygen-enriched air (air having oxygen concentration greater than 21 mole percent), and "pure" oxygen grades, such as industrial grade oxygen, food grade oxygen, and cryogenic oxygen. Oxygen-enriched air may have 50 mole percent or more oxygen, and in certain embodiments may be 90 mole percent or more oxygen. Primary, secondary, and tertiary oxidant are terms understood in the combustion burner art; burners employed herein may use any one or more of these.

The term "fuel", according to this disclosure, means a combustible composition comprising a major portion of, for example, methane, natural gas, liquefied natural gas, propane, butane, hydrogen, steam-reformed natural gas, atomized hydrocarbon oil, combustible powders and other flowable solids (for example coal powders, carbon black, soot, and the like), and the like. Fuels useful in the disclosure may comprise minor amounts of non-fuels therein, including oxidants, for purposes such as premixing the fuel with the oxidant, or atomizing liquid or particulate fuels. As used herein the term "fuel" includes gaseous fuels, liquid fuels, flowable solids, such as powdered carbon or particulate material, waste materials, slurries, and mixtures or other combinations thereof.

The sources of oxidant and fuel may be one or more conduits, pipelines, storage facilities, cylinders, or, in embodiments where the oxidant is air, ambient air. Oxygen-enriched oxidants may be supplied from a pipeline, cylinder, storage facility, cryogenic air separation unit, membrane permeation separator, or adsorption unit such as a vacuum swing adsorption unit.

Figure 2:
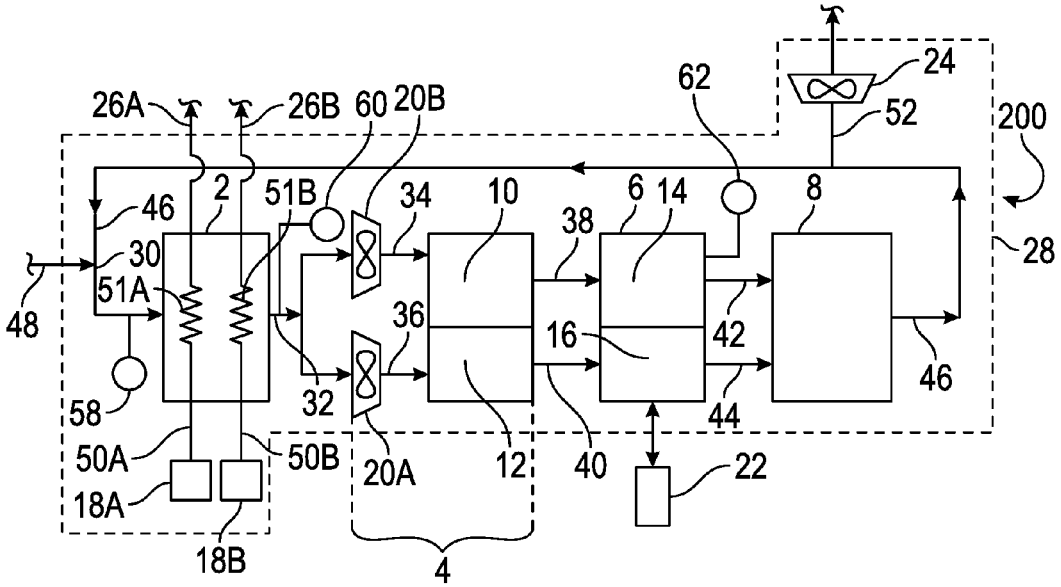

FIGS. 1 and 2 illustrate schematic process flow diagrams of two methods, systems, and apparatus embodiments 100 and 200 in accordance with the present disclosure. Embodiments 100 and 200 illustrated schematically in FIGS. 1 and 2, respectively, each include an air heating zone 2, a heated air supply zone 4, a wood treatment zone 6, and a cooled air return zone 8. The heated air supply zone 4 includes a left side heated air plenum 10 and a right side heated air plenum 12, while the wood treatment zone 6 includes a left side wood treatment zone 14 and a right side wood treatment zone 16. ("Left" and "right" are arbitrarily chosen as viewed from the rear of the structure of embodiment 300 as illustrated schematically in FIG. 4. An "A" for an element indicates right side, while a "B" indicates left side.) Both embodiments 100 and 200 include a movable cart, carriage, or compression skid 22, as further described herein, and a cooled air vent blower 24.

Comparing embodiments 100 (FIG. 1) and 200 (FIG. 2), embodiment 100 includes a single air recirculating blower 20, while embodiment 200 includes two such blowers 20A, 20B. Suitable air recirculation blowers have a capacity ranging from about 5,000 to about 50,000, CFM, or from about 10,000 to about 20,000 CFM, and use an electric motor driver with variable flow, such as having a power of about 10 to about 30 HP, or from about 15 to 25 HP. Such blowers are commercially available, for example, from Twin City Fans a & Blowers, Minneapolis, Minn. Embodiment 100 includes a single heating unit (for example, a combustion burner or Joule heating element) 18, having conduits for feed of fuel "F" and oxidant "O" as illustrated for a combustion burner, if used. Embodiment 200 includes two heating units 18A and 18B, which could be combustion burners, electric Joule heating units, or one of each. One exhaust stack or conduit 26 is illustrated in embodiment 100, while embodiment 200 includes two such stack conduits, 26A, 26B. One end of these conduits is connected fluidly to the heating unit, and the other to the roof of the air heating zone. A dotted line 28 in each of FIGS. 1 and 2 indicates the wood treatment structure periphery, with components and flow streams within the dotted line being within a wood treatment structure, and components and flow streams outside the dotted line being outside of the wood treatment structure.

Following the airflow in embodiment 100 illustrated schematically in FIG. 1, a cooled air stream 30 enters air heating zone 2 and exits as a heated air stream 32. In embodiment 100, heated air stream 32 is induced to enter air recirculation blower 20 by natural suction, and then splits into a left side heated air stream 34 and a right side heated air stream 36. Embodiment 200 differs by splitting heated air stream 32 to flow into left side and right side air recirculation blowers 20B, 20A. In both embodiments 100 and 200, left side heated air stream 34 is forced by the discharge pressure of blower 20 (or blowers 20B, 20B) into left side plenum 10 and right side heated air stream 36 is forced by blower 20 (or blowers 20B, 20B) into right plenum 12, and out of the plenums to form a left side heated air stream 38 and a right side heated airstream 40. Left side heated air stream 38 contacts wood products in left side wood treatment zone 14, and right side heated air stream 40 contacts wood products in right side wood treatment zone 16. During this contacting each heated air stream partially enters spaces between wood panels, but mainly flows upwardly past the side edges of the wood panels being treated, drawing moisture out thereof by capillary action. Some moisture also escapes the wood panels from the major surfaces thereof. The heated air is thereby cooled, forming a left side cooled air stream 42 and a right side cooled air stream 44 in each schematically illustrated embodiment 100, 200. The left and right cooled air streams are collected above the stacked wood, below a roof or ceiling of the wood treating structure 28, forming a combined cooled air stream 46, which is circulated back to form cooled air stream 30, differing therefrom only by combining with any ambient air and moisture leaking into the structure, as indicated by the air stream 48.

Hot air conduit or hot combustion product conduit 50 (FIG. 1) or 50A and 50B (FIG. 2) are fluidly connected to heating unit 18 (FIG. 1) or 18A, 18B (FIG. 2) and continue through a wall of the air heating zone 2 to form heat transfer surfaces 51 (FIG. 1) or 51A, 51B (FIG. 2), the heat transfer surfaces collectively referred to herein as a heat exchange substructure. In embodiments such as illustrated embodiment 100, when combustion burners are used as heating units, a fuel supply train 54 and an oxidant supply train 56 are provided, as further described herein. In certain embodiments the oxidant supply train may simply be a conduit and an air filter for a burner. For brevity, these items are not illustrated in embodiment 200. Rather there is illustrated schematically a cooled air sensor or sensors 58 (either temperature, relative humidity, or both), a heated air sensor or sensors 60 (which also cold be temperature, relative humidity, or both). Also illustrated in embodiment 200 is one or more wood sensors 62, which could be wood temperature and or wood moisture sensors, or both. It is understood that such air temperature and RH sensors, and wood temperature and moisture sensors could be employed in all embodiments, and such sensors are well known in the art and require no further discussion.

During operation of embodiments 100, 200 and other embodiments described herein, the heat exchange substructure may include one or more airflow diverters (baffles and the like) for effecting indirect heat exchange from hot air or hot combustion products from heating units 18. Cooled air stream 30 flows tortuously through the heat exchange substructure, on the outside or inside surfaces thereof, while hot air or hot combustion products flow tortuously on the opposite side of the heat transfer surfaces of the heat transfer substructure. Airflow diverters may for example comprise one or more baffles, distributor plates, grids, and the like for causing a tortuous flow path. Airflow diverters may take any shape, for example flat plates, corrugated plates, plates having a variety of projections or protuberances therefrom such as spikes, knobs, lumps, bumps, and the like, of a variety of sizes, or all the same size. In certain embodiments the relative flows of cooled airstream 30 and hot air or hot combustion products through the heat exchange substructure may be counter-current, co-current, or cross-current (cross-flow). Flow of airstreams 30, 32, 34, 36, 38, 4042, 44, and 46 may be continuous, semi-continuous while there is a load of wood or wood products in the structure, while the "flow" or treatment of wood is batch or semi-batch. Airflows may be continued while loading and unloading wood batches, but may also be reduced or stopped.

Referring again to FIG. 1 and schematically illustrated embodiment 100, a cooled air vent conduit 52 is provided, in conjunction with one or more cooled air vent blowers 24. Suitable vent air blowers may have a capacity of about 500 to about 5000 standard cubic feet per minute (SCFM), or from about 500 to about 2000 SCFM, driver by a 1 to 5 HP variable frequency drive motor, such as available from Twin City Fans & Blowers, Minneapolis, Minn. In embodiment 100, cooled air return zone 8 is vented, while in embodiment 200 (FIG. 2), a cooled air vent conduit 52 takes off from the cooled air return line (described herein in conjunction with FIGS. 8-10 as a cooled air return duct). Cooled air venting through conduit 52 may be controlled in flow rate by an airflow control component (not illustrated) such as a sliding gate device, valve, or other component that functions to control and/or stop venting of cooled of air in case of emergency, for example, a problem with heating units 18. One or more pressure relief devices (not illustrated) may also be provided. Cooled air vent conduit 52 may fluidly connect to cooled air return zone 8 or cooled air recirculation conduit 46 through a 3-way connector, while a second 3-way connector may fluidly connect heated air conduit 32, and split the heated airflow to multiple recirculation blowers, such as illustrated in FIG. 2 at 20A, 20B. 3-way connectors may be Y-connectors, T-connectors, and the like.

Figure 3:
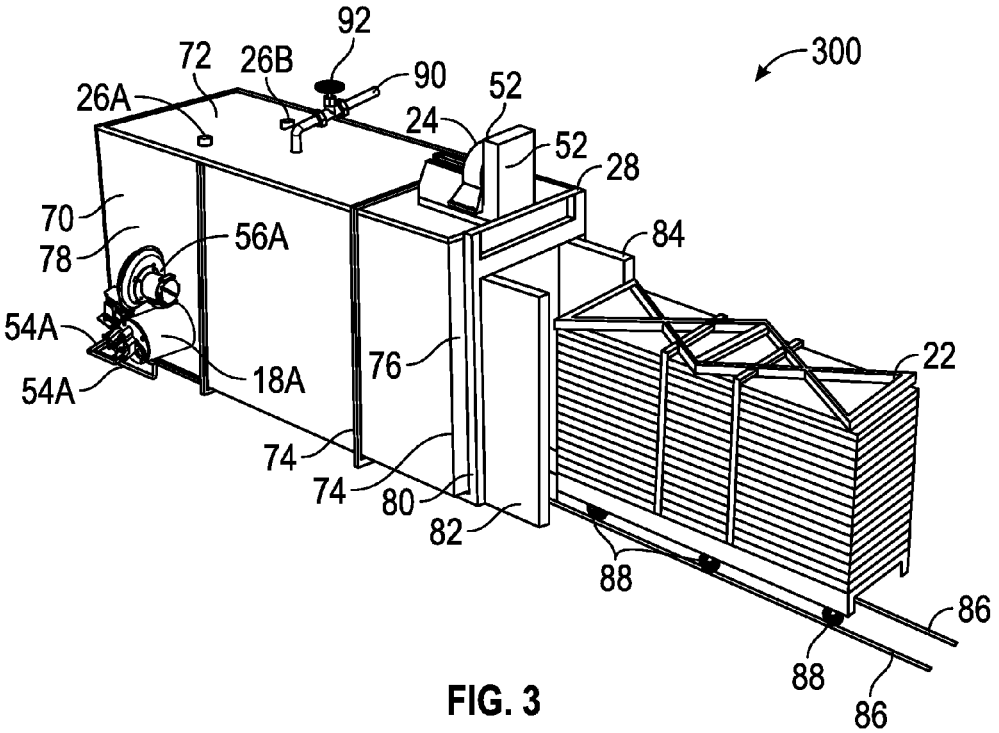
FIGS. 3 and 4 are two schematic perspective views of one oven and cart embodiment in accordance with the present disclosure.
Figure 4:
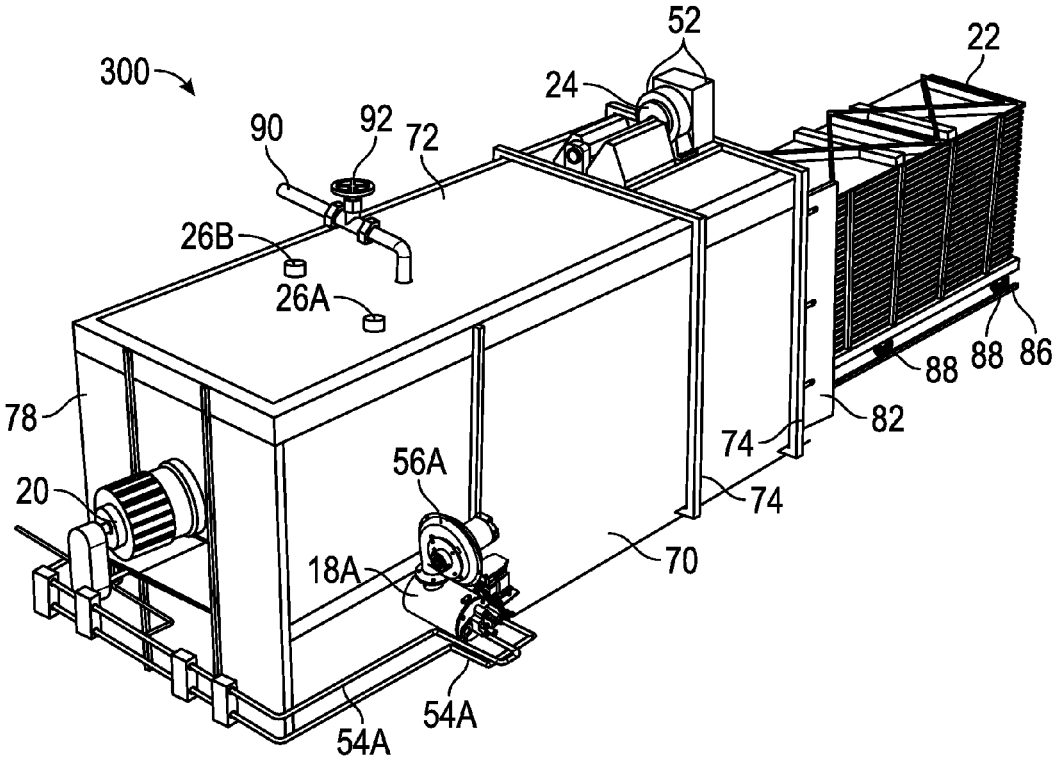

FIGS. 3 and 4 are two schematic perspective views of one oven and cart embodiment 300 in accordance with the present disclosure. Wood treatment structure (oven) embodiment 300 includes insulated sidewalls 70 (only one of which is visible in FIGS. 3 and 4), an insulated roof 72, an insulated front wall 76, and an insulated rear wall 78, all of which are constructed from commonly available materials, as discussed more fully herein in conjunction with FIG. 10. The oven insulated sidewalls 70, roof 72, and end walls 76 and 78 are held together by a frame 74, typically composed of metal members such as structural steel bar stock, rectangular tubular members, or other structural steel members. An oven door frame 80 is also provided, constructed of steel or other members, similar to or different from members comprising frame 74, from which are hung insulated right and left doors 82, 84. Alternatively, a single door may be used. A pair of rails 86 is provided, onto which ride wheels 88 of cart or carriage 22, which may be moved into and out of heat treating structure 28. A cooling water supply conduit 90 and control valve 92 are also provided, used to provide moisture to a load of wood when desired, either during dry (low humidity) atmospheric conditions, or during an emergency to wet the load of wood.

Figure 5:
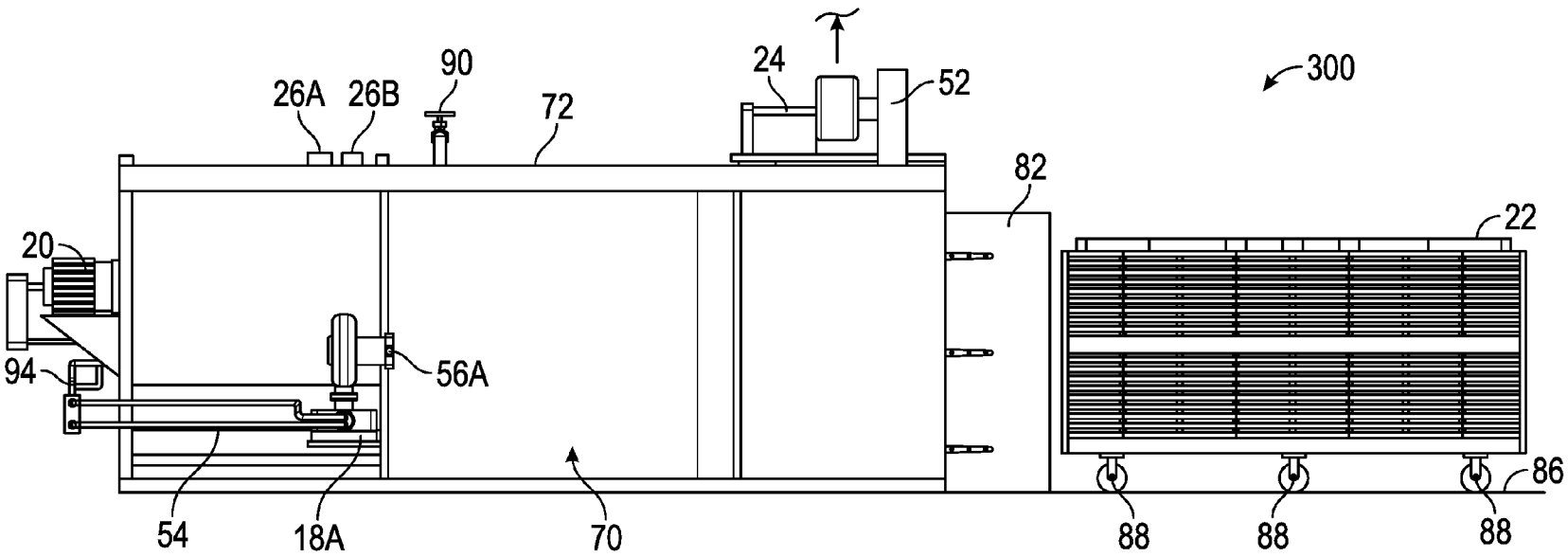
FIGS. 5, 6, and 7 are schematic side elevation, plan, and front end elevation views, respectively, of the embodiment of FIGS. 3 and 4.
Figure 6:
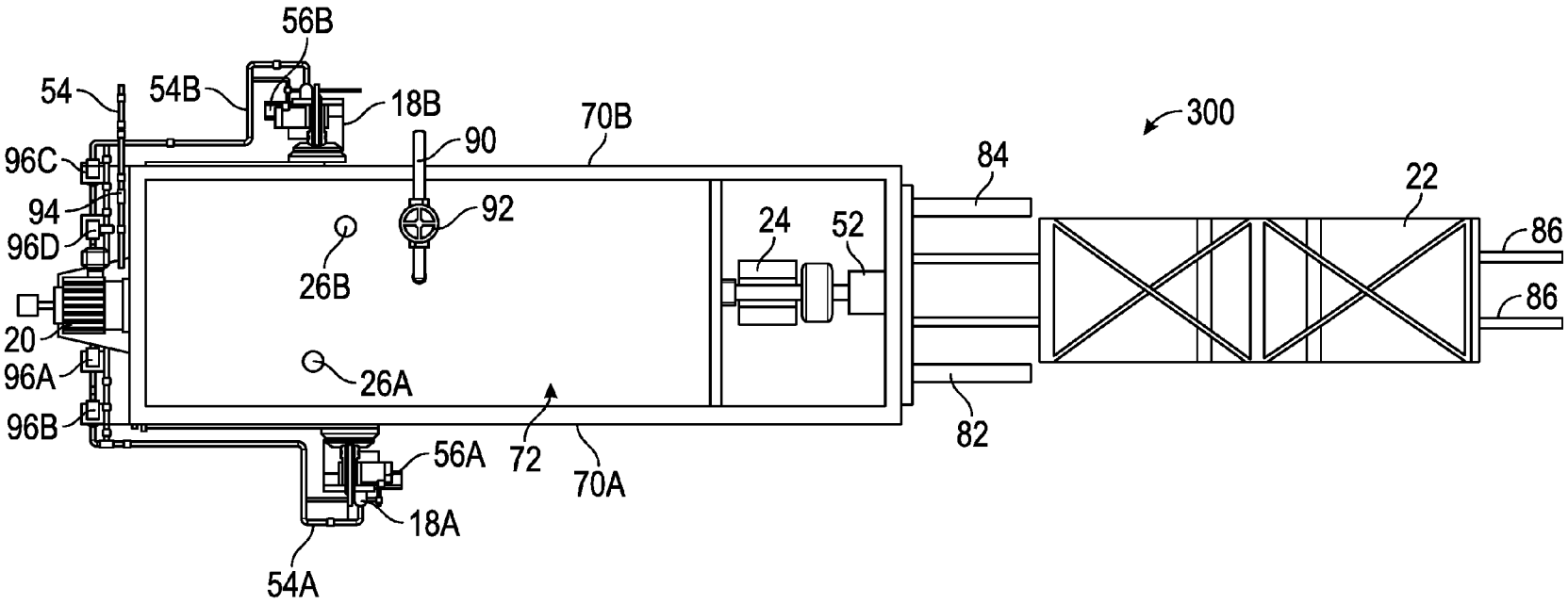
Figure 7:
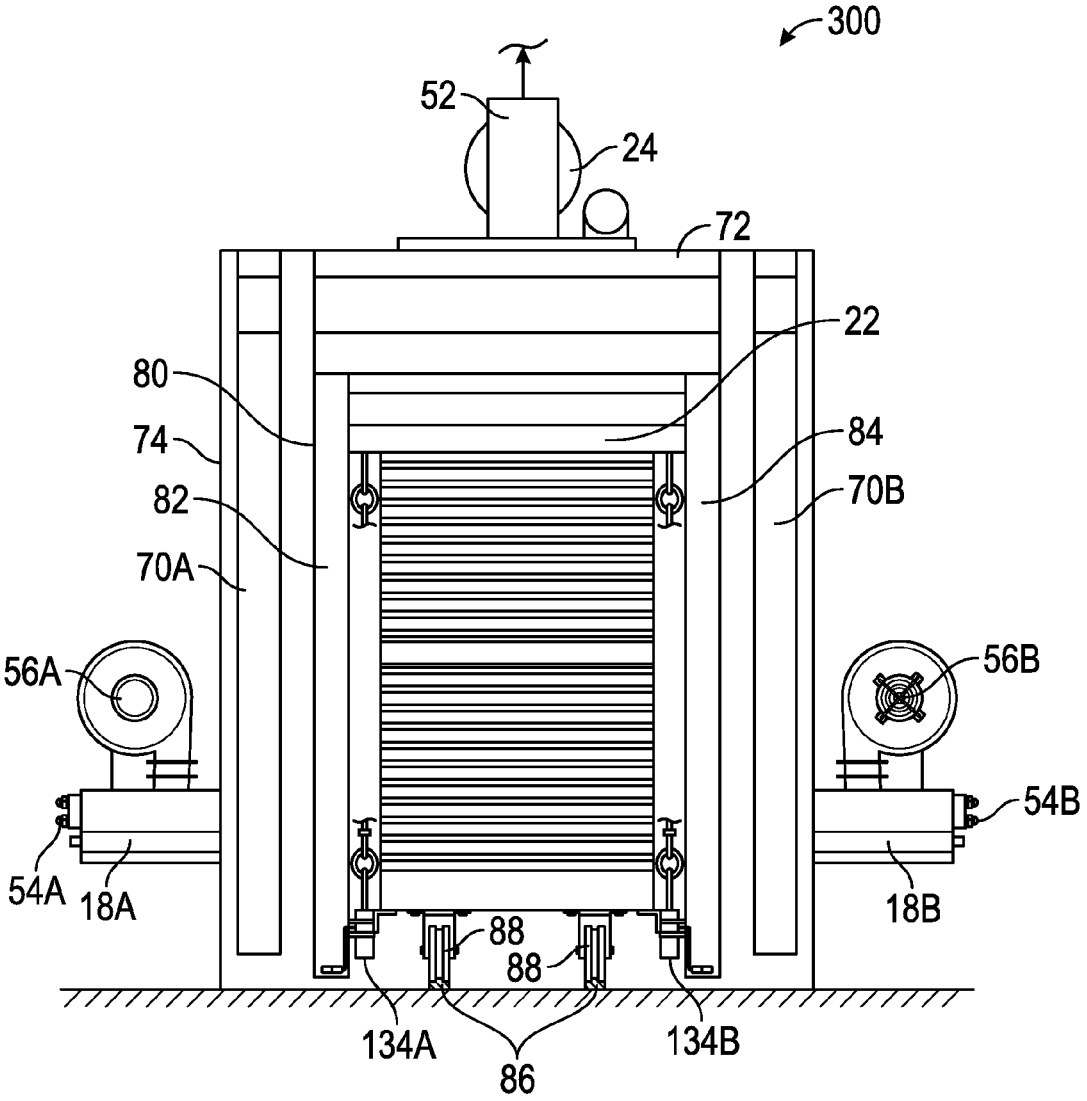

FIGS. 5, 6, and 7 are schematic side elevation, plan, and front end elevation views, respectively, of embodiment 300 illustrated schematically in FIGS. 3 and 4. Plan view illustration of FIG. 5 illustrates two combustion burners 18A, 18B, taking fuel feed through a primary fuel supply conduit 54, a fuel primary flow regulator 94 in conduit 54, which then splits into right side and left side fuel supply conduits 54A and 54B configured to feed right side and left side combustion burners 18A, 18B, which also take in air through connections 56A, 56B. Dual fuel mass flow controllers 96A, 96B may be employed in fuel conduit 54A, while dual fuel mass flow controllers 96C, 96D may be provided in fuel supply conduit 54B. Burner 18A is attached directly to right sidewall 70A, while burner 18B is attached directly to left sidewall 70B. Front end elevation view of FIG. 7 illustrates how the cart of wood fits closely into, but does not touch, the heated air supply plenums or cooled air return ducts, perhaps better illustrated in FIG. 12, described herein.

Figure 8:
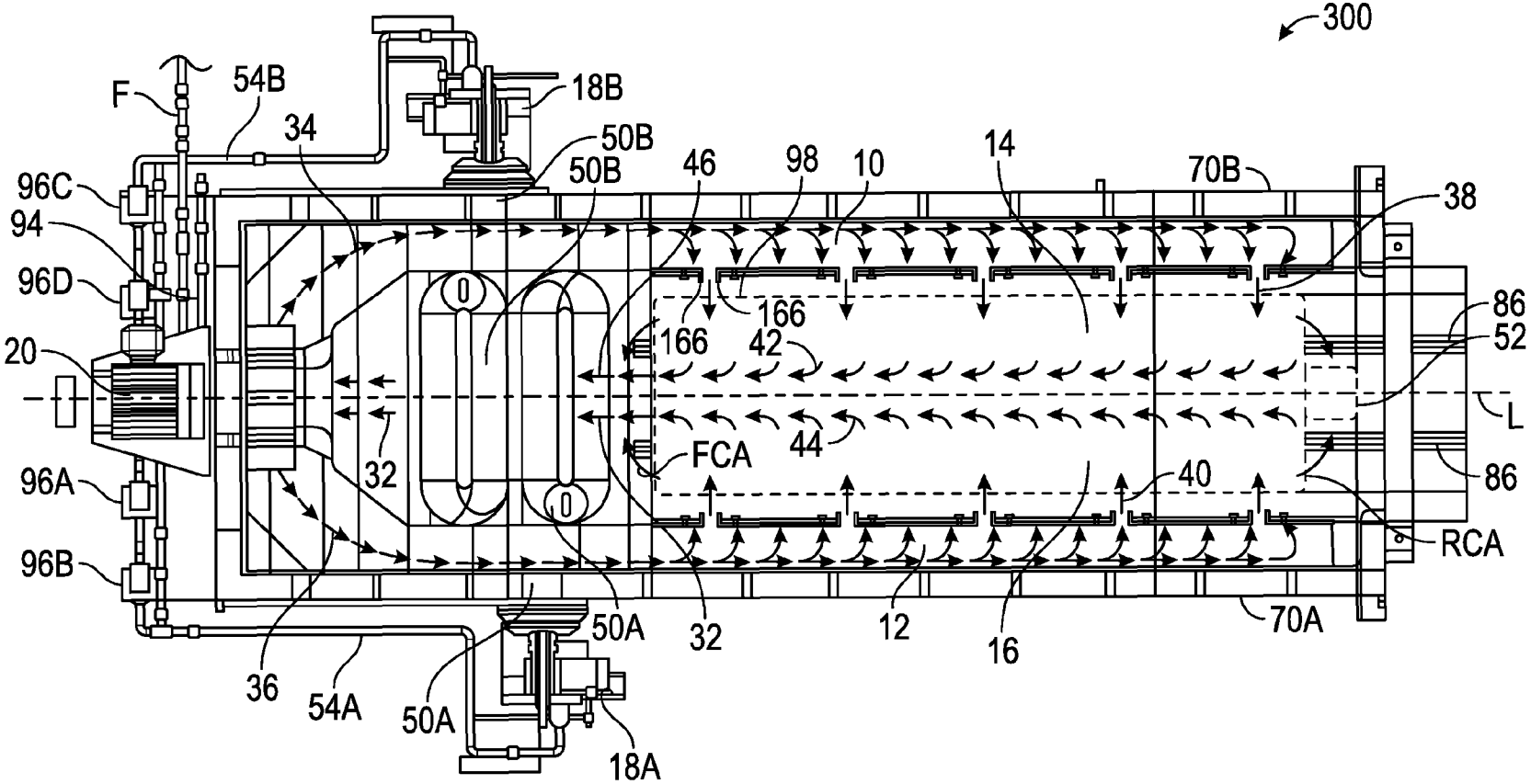
FIGS. 8 and 9 are schematic plan and side elevation views, respectively, with portions cut away to show internal air flow patterns, of the embodiment of FIGS. 3-7.
Figure 9:
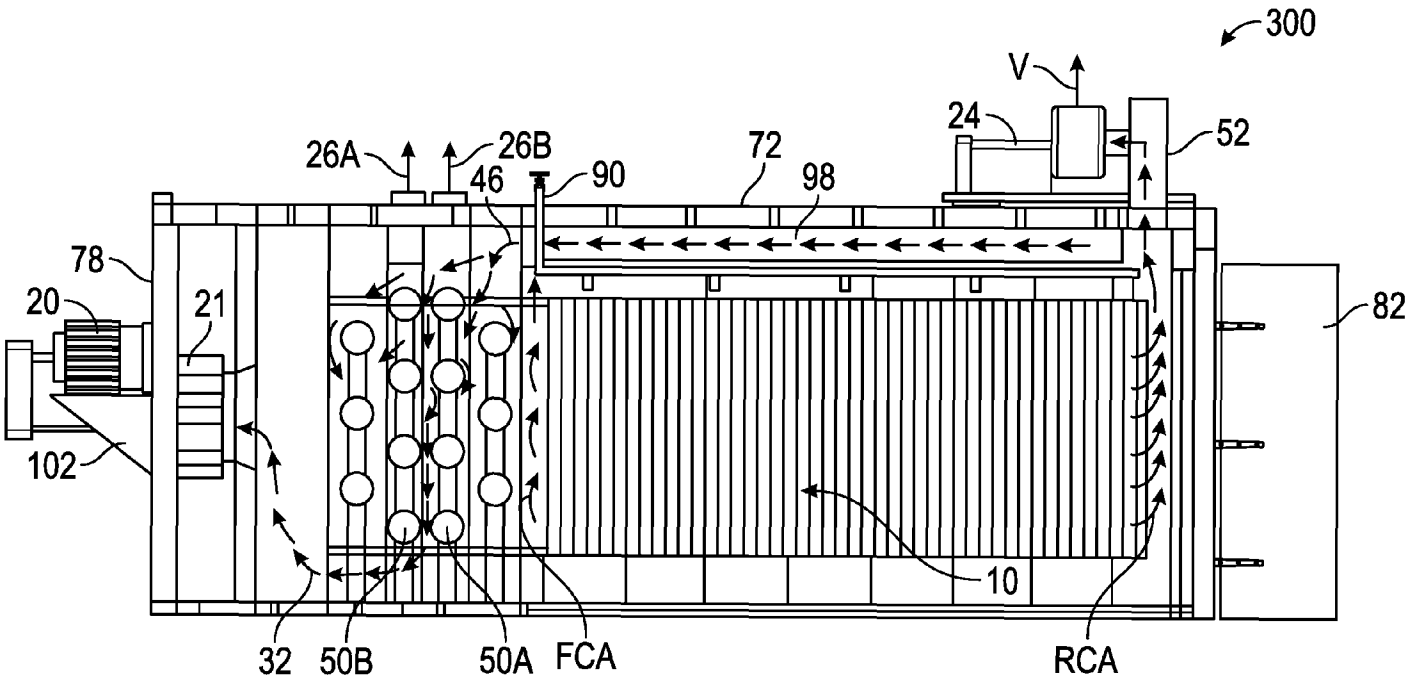

FIGS. 8 and 9 are schematic plan and side elevation views, respectively, with portions cut away to show internal airflow patterns, of embodiment 300 illustrated schematically in FIGS. 3-7, illustrating a cooled air return duct 98 in dashed lines. Rear cooled air ("RCA") and front cooled air ("FCA") emanate from the rear and front, respectively, of the stacked wood, drawing out moisture from the rear and front edges of the wood products being treated. Left side and right side cooled air streams 42, 44 are illustrated collecting in cooled air duct 98, forming combined cooled air stream 46, which is routed tortuously downward and through heat exchange substructure formed by heat transfer surfaces formed by hot combustion exhaust conduits 50A, 50B, them forming heated air stream 32 which is drawn into impellers 21 of recirculation air blower 20. A support bracket 102 for air recirculation blower 20 is illustrated in FIG. 9. As illustrated schematically in FIG. 8, the heated air stream 32 is divided into left and right side heated air streams 34, 36 which in turn are forced into left side and right side heated air plenums 10, 12. The inside structure of heated air plenums 10, 12 comprises a series of slits, holes, and/or other shaped passages allowing the heated air to escape the plenums and travel up and around the side edges of wood panels stacked on the cart as previously described. The combination of positive pressure from recirculation air blower 20 and reduced pressure induced by vent blower 24 aide air flows and allows a cyclic air flow pattern as illustrated.

Figure 10:
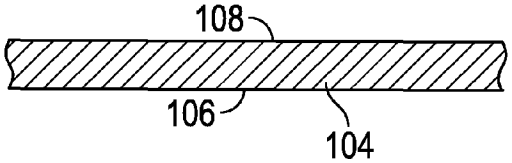
FIG. 10 is a detailed cross-section of a wall of the embodiment of FIGS. 3-9.

FIG. 10 is a detailed cross-section of a sidewall, end wall, or roof of the embodiment 300 illustrated schematically in FIGS. 3-9, featuring insulating material 104, which may be mineral wool, glass wool or other insulating material, for example 6 inch thick 8 pound density mineral wool, sandwiched between an external wall panel 106, for example 18 gage carbon steel primed and painted, and an internal wall panel 108, for example aluminized 18 gage carbon steel or stainless steel, such as 304 or other stainless steel. More exotic metals may be used for all or portions of the internal wall panel 108, if desired, such as precious metals and/or noble metals (or alloys). Noble metals and/or other exotic corrosion and/or fatigue-resistant materials include metals such as platinum (Pt), ruthenium (Ru), rhodium (Rh), palladium (Pd), silver (Ag), osmium (Os), iridium (Ir), and gold (Au); alloys of two or more noble metals; and alloys of one or more noble metals with a base metal may be employed. In certain embodiments a protective layer or layers or components may comprise an alloy attached to a base metal using brazing, welding or soldering of certain regions.

Figure 11:
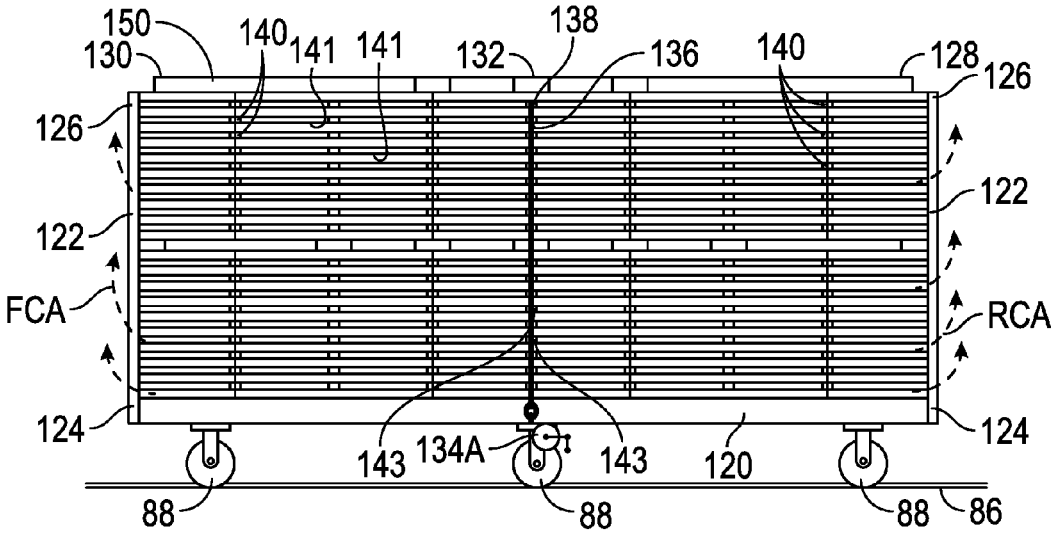
FIG. 11 is a schematic side elevation view of the cart of the embodiment of FIGS. 3 and 4.

FIG. 11 is a schematic side elevation view of the cart 22 of embodiment 300 illustrated schematically in FIGS. 3-9. Cart 22 includes a floor 120, preferably a rectangular member having a length and width generally just smaller than the internals of wood treatment structure 28. For example, the cart width may be 75 percent, or 80, 81, 82, 83, 84, 85, 86, 87, 88, 89, or 90 percent of the distance between the left and right side plenums' inner walls, or even 91, 92, 93, 94, or 95 percent. The same percentages may describe the relationship between the height of the cart and the lower part of cooled air return duct 98 or other roof member. Cart 22 is further composed of vertical corner supports 122, preferably one attached on each corner of floor 120, the lower ends 124 of supports 122 attached to the floor 120 via bolts, welding, clamping, or other attachment mechanism. Upper ends 126 of supports 122 are attached to cross-members 128 and 130 on the rear and front, respectively of cart 22. The terms "rear" and "front" are relative and could be switched, as will be understood by those skilled in the art. A central cross-member 132 and diagonal support members 150 are also provided in this embodiment. Floor 120, vertical supports 122, cross-members 128, 130, and 132, and diagonal support members 150 may be made of wood, steel, structural plastic, or other structural material suitable attached together via bolts, welding, clamping, or other attachment mechanism. Rear cooled air ("RCA") and front cooled air ("FCA") are illustrated in dashed arrows as they would emanate from the rear and front, respectively, of the stacked wood, drawing out moisture from the rear and front edges of the wood products being treated.

Figure 12:
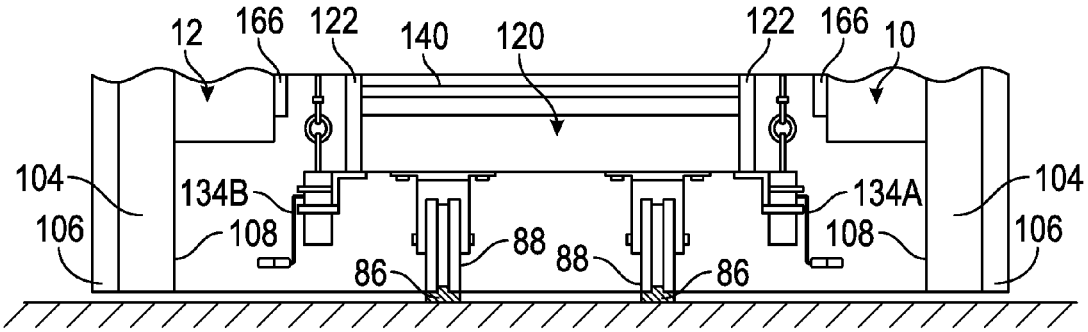
FIG. 12 is a detailed front end elevation of the oven and cart of the embodiment of FIGS. 3 and 4.

FIG. 12 is a detailed front end elevation of the oven and cart of embodiment 300 illustrated schematically in FIGS. 3-4, illustrating right and left side winches 134A and 134B welded or bolted to floor 120 of cart 22. Winches 134A and 134B convert the cart 22 into a "compression skid" when used in conjunction with winch links 136 (loops) and winch rods 138, which connect winch links 136.

FIGS. 13, 13A, 14, and 14A are schematic detailed cross-sectional views of wood panels loaded onto the cart of embodiment 300 illustrated schematically in FIGS. 3 and 4. Upper metal plates 140 and lower metal plates 141 sandwich eight wood boards or panels 152. Cart tubular members 143

Figure 13:
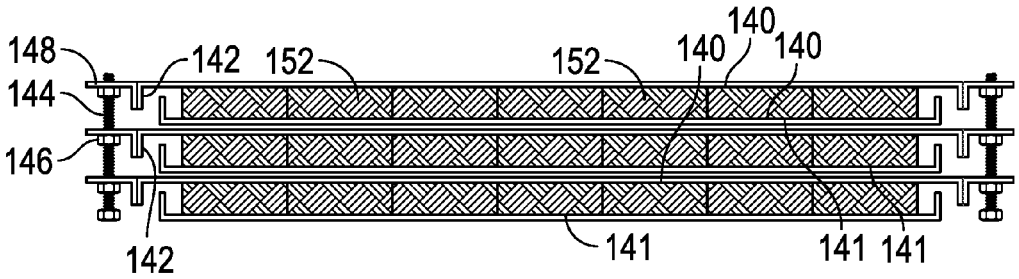
FIGS. 13 and 14 are schematic detailed cross-sectional views of wood panels sandwiched between upper and lower metal plates loaded onto the cart of the embodiment of FIGS. 3 and 4, and FIGS. 13A and 14A illustrate further details.
Figure 13A:
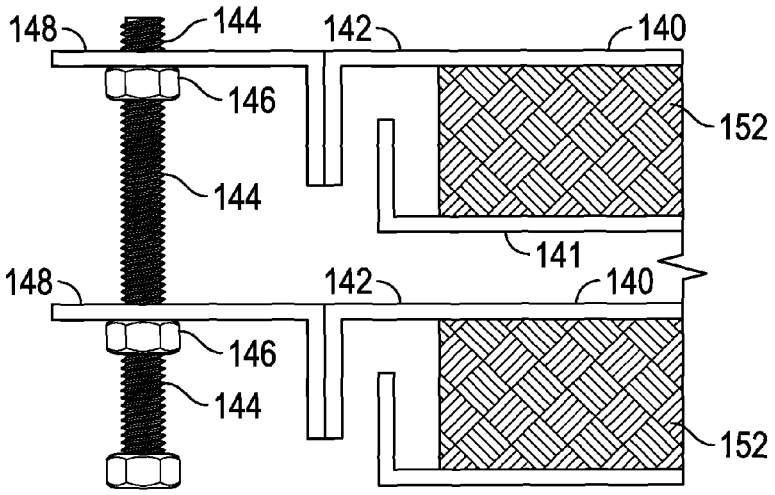
Figure 14:
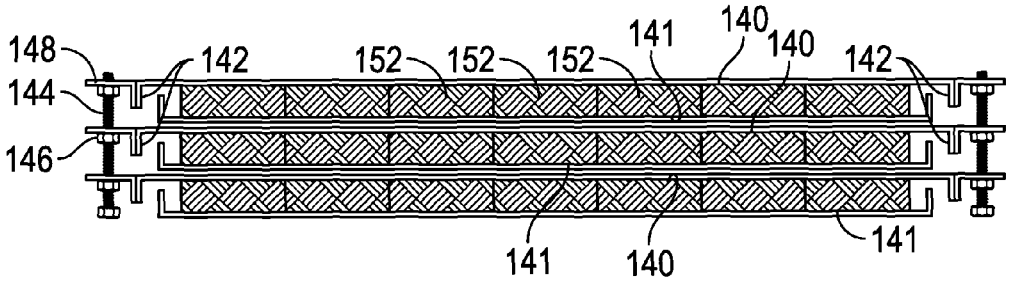
Figure 14A:
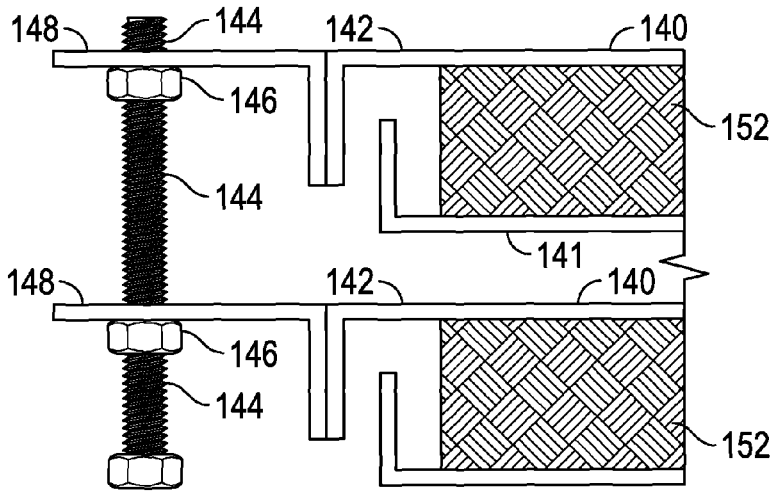

(FIG. 11) separate upper and lower metal plates 140, 141, at various locations along the length of the cart. FIG. 13 illustrates wood panels having a thickness of 1.125 inch (28 mm) being treated, while FIG. 14 illustrates wood panels having a thickness of 2 inches (50 mm) being treated, these sizes being standard sizes for laminates used for wood flooring. As illustrated in detail in FIGS. 13A and 14A, upper metal plates 140 include end corners 142, and these ends corners 142 are welded to angles 148. Angles (angle iron, carbon steel or other steel) have holes or passages therein (drilled or cast) and used with guide rods 144 held by nuts 146. When desired to compress the skid and thus the wood panels being treated, winches 134A, 134B are cranked, either by hand or other mechanism, and since they are connected to winch links 136 and winch rods 138, which are in turn connected to cross-central cross-member 132, the entire load of wood panels will be compressed vertically downward toward the floor 120 of cart 22, and each row of wood panels will be compressed between metal plates 140, 141. Rods 144 maintain the tubular members in vertical alignment, which is desired for uniform treatment of the wood panels 152.

The cart is designed with unique adjustable metal plates 140, 141. In one example, flat wood pieces 8 inches wide, up to 13 feet long and up to 2 inches thick are sandwiched between two metal plates 140, 141. Since in this example there are total of 40 plates, this provides loading capability for 20 rows of wood. In embodiment 300, each row has 6 pieces of wood sandwiched between each set of plates 140, 141, which may be for example 10 gauge carbon steel plates. The cart plates are uniquely designed for loading where they are attached to each other using the threaded rods 144 with nuts 146 but still can be separated. In order to separate plates 140, 141 for loading of the wood, a forklift, crane, or other mechanism picks the top plate up and since all other plates are attached to each other using threaded rods they separate like an accordion allowing smooth loading of the wood from the front into each row of the plates. Each row (two plates which sandwich the wood) are separated from each other using welded spacers (tubulars 143). So the rows of plates have an air gap between them of whatever the height of the tubulars 143 is, in this example 1-inch height. Each of the upper and lower plates 140, 141 is bent on the long sides at a 90° angle, covering the long edges of the outer-most wood panel, so it is not exposed to the direct impingement of the hot air. This allows hot recirculated air to flow between the rows of plates heating the wood evenly but not allowing hot air to directly contact the wood. At the same time all rows of the wood are compressed keeping the wood pieces straight. Each plate may have dimensions of 4 feet×13 feet×10 gauge thick, but may be smaller or larger.

Figure 15:
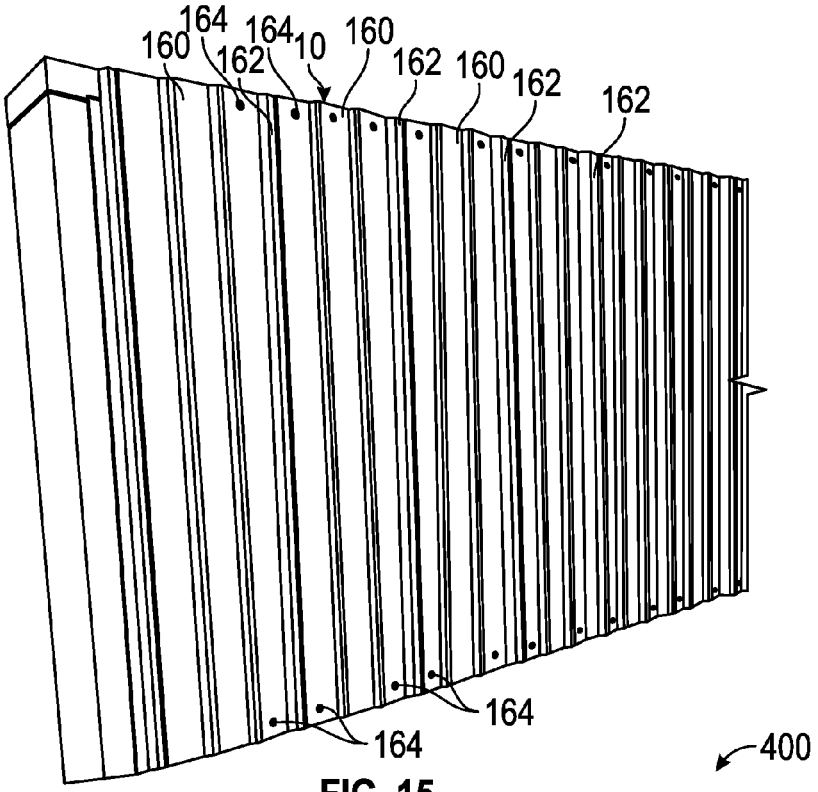
FIG. 15 is a perspective and view of a sheet metal plenum panel and a set of vertical sheet metal nozzles.
Figure 16:
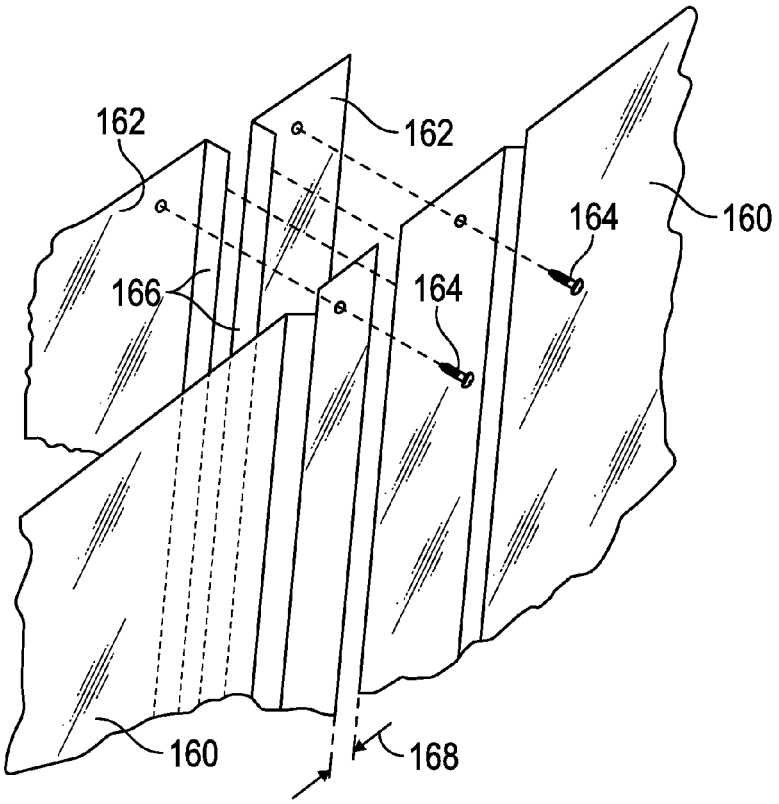
FIG. 16 is an exploded view of a nozzle and how it attaches to a plenum panel of FIG. 15 using screws.

FIG. 15 is a perspective and view of a sheet metal plenum 10 constructed of a set of sheet metal panels 160 and a set of vertical sheet metal nozzles 162, and FIG. 16 is an exploded view of a nozzle 162 and how it attaches to a pair of plenum panels 160 of FIG. 15 using screws 164. The design of the airflow pattern is unique due to the requirement of recirculating hot air from the indirect fired heat exchanger through the 1" high opening between each raw of the plates which sandwich the wood pieces. The nozzle 162 design, having lips or projections 166 that protrude out through gap 168 between plenum panels 160 was based on having adjustable nozzles capable of processing the hot air between each row of plates which resulted in uniform heating of the wood. The nozzles were designed and manufactured by Epcon Industrial Systems, LP, The Woodlands, Tex., USA, the assignee of the present application. They are attached to the plenum panels using sheet metal screws, which allows the nozzles to be adjusted right or left, depending on the depth that the left and rights screws are driven into their receptacles.

In operation, hot air flows out of left and right heated air plenums 10, 12 through nozzles 162 on the inside wall of each plenum. These nozzles 162 can by adjusted right and left, balancing the air flow and temperature uniformity inside the oven. One unique aspect of systems and methods of this disclosure is that hot air is supplied through the supply plenum nozzles 162 on both sides of the oven. The hot air is forced between the rows of plates 140, 141 on both sides into the opening between the rows of plates and returned upward through the return cooled air duct 98. But before it is returned, due to the impingement from both sides into the gaps between the rows of plates it creates turbulence between rows of plates creating high turbulence and high coefficient of heat transfer which results in great temperature uniformity transferred through the plates into the wood. This is done with constant hot air supply from both sides into the air gaps or regions between the rows formed by the plates which forces the now cooler air to exit the air gaps through the front and back of the rows of plates (on the front and back of the cart) and then up into the cooled air return duct 98. The long-side edges of the outer wood panels in each row are covered by the corners of the plates, as illustrated in FIGS. 13, 13A, 14, and 14A, protecting the wood by not allowing direct contact with high temperature supplied air. But front and back edges of the wood in each row are open where the moisture and any cured chemical can escape and be removed. The nozzles were designed and manufactured by Epcon. They are screwed to the plenums using sheet metal screws. The reason for using the sheet metal screws is adjustability.

Figure 17:
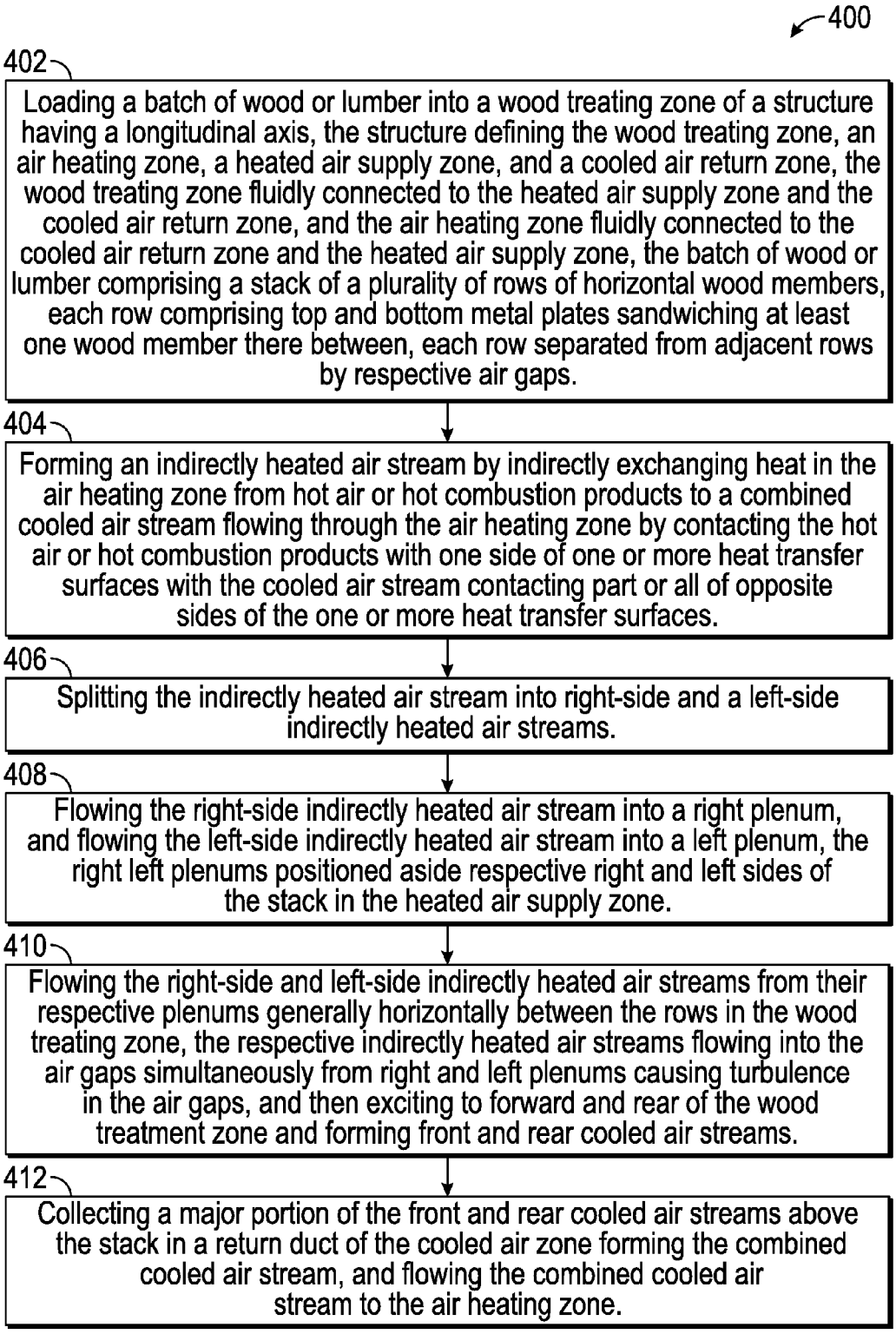
FIG. 17 is a logic diagram of one method embodiment of treating wood products in accordance with the present disclosure.

FIG. 17 is a logic diagram of one method embodiment 400 of treating wood products in accordance with the present disclosure. Method embodiment 400 method comprises (or in certain embodiments consists essentially of, or in yet other embodiments consists of) loading a batch of wood or lumber into a wood treating zone of a structure having a longitudinal axis "L", such as illustrated in FIG. 8, the structure defining the wood treating zone, an air heating zone, a heated air supply zone, and a cooled air return zone, the wood treating zone fluidly connected to the heated air supply zone and the cooled air return zone, and the air heating zone fluidly connected to the cooled air return zone and the heated air supply zone, the batch of wood or lumber comprising a stack of a plurality of rows of horizontal wood members, each row comprising top and bottom metal plates sandwiching at least one wood member there between, each row separated from adjacent rows by respective air gaps (box 402). Method embodiment 400 further comprises forming an indirectly heated air stream by indirectly exchanging heat in the air heating zone from hot air or hot combustion products to a combined cooled air stream flowing through the air heating zone by contacting the hot air or hot combustion products with one side of one or more heat transfer surfaces with the cooled air stream contacting part or all of opposite sides of the one or more heat transfer surfaces (box 404). Method embodiment 400 further comprises splitting the indirectly heated air stream into right-side and a left-side indirectly heated air streams (box 406). Method embodiment 400 further comprises flowing the right-side indirectly heated air stream into a right plenum, and flowing the left-side indirectly heated air stream into a left plenum, the right and left plenums positioned aside respective right and left sides of the stack in the heated air supply zone (box 408).

Method embodiment 400 further comprises flowing the right-side and left-side indirectly heated air streams from their respective plenums generally horizontally between the rows in the wood treating zone, the respective indirectly heated air streams flowing into the air gaps simultaneously from right and left plenums causing turbulence in the air gaps, and then exiting to forward and rear of the wood treatment zone and forming front and rear cooled air streams (box 410). Method embodiment 400 further comprises collecting a major portion of the front and rear cooled air streams above the stack in a return duct of the cooled air return zone forming the combined cooled air stream, and flowing the combined cooled air stream to the air heating zone (box 412).

In certain embodiments, the step of indirectly exchanging heat in the air heating zone comprises (or in certain embodiments consists essentially of, or in yet other embodiments consists of) hot combustion products from one or more combustion burners flowing through one or more heated tubular members to a combined cooled air stream flowing through the air heating zone, the hot combustion products formed by combusting one or more fuels with one or more oxidants in the one or more combustion burners attached to the structure externally of the air heating zone, one or more burner exhaust conduits fluidly connected at a first end to the one or more combustion burners and at a second end to a roof of the structure, the one or more exhaust conduits defining the heated tubular members arranged in an indirect heat exchange substructure in the air heating zone.

In certain method embodiments, the loading comprises (or in certain embodiments consists essentially of, or in yet other embodiments consists of) moving a removable cart or carriage loaded with the stack of wood or lumber into the wood treating zone, the removable cart or carriage and load of wood thereon closely fitting within the wood treating zone but not touching the left and right plenums or the return duct.

In certain method embodiments, the method comprises (or in certain embodiments consists essentially of, or in yet other embodiments consists of) exhausting a minor portion of the combined cooled air stream from the cooled air return zone.

In certain method embodiments, the directing of the combined cooled air stream past the one or more heated tubular members in the air heating zone comprises (or in certain embodiments consists essentially of, or in yet other embodiments consists of) flowing the combined cooled air stream in cross-flow pattern across outer surfaces of the heated tubular members.

In certain method embodiments, the combined cooled air stream flows generally downward while passing across the outer surfaces of the heated tubular members.

In certain method embodiments, the fuel is selected from the group consisting of methane, gaseous natural gas, liquefied natural gas, propane, butane, hydrogen, steam-reformed natural gas, atomized hydrocarbon oil, combustible powders, flowable solids, waste materials, slurries, and mixtures or other combinations thereof, and the oxidant is selected from the group consisting of air, gases having the same molar concentration of oxygen as air, oxygen-enriched air having 50 mole percent or more oxygen, industrial grade oxygen, food grade oxygen, and cryogenic oxygen.

In certain method embodiments, the cooled air is heated to a temperature ranging from about 150° F. to about 650° F. (66° C. to about 343° C.).

Certain method embodiments comprise (or in certain embodiments consists essentially of, or in yet other embodiments consists of) controlling moisture removal from the wood or lumber by one or more control methods selected from the group consisting of monitoring humidity of the left, right, or combined cooled air stream, monitoring humidity of the indirectly heated air stream, monitoring one or more temperatures of the left, right, or combined cooled air steams and/or heated air streams, and combinations thereof.

In certain method embodiments, the wood or lumber is selected from the group consisting of natural woods, composites, and laminates. In certain method embodiments, the natural wood is selected from the group consisting of pine, spruce, hardwoods, and sustainable wood species.

Methods and systems of the present disclosure may include one or more thermocouples, RH sensor, and/or moisture sensors for monitoring and/or control of temperature of the wood treatment, for example using a controller. A signal may be transmitted by wire or wirelessly from a thermocouple or other sensor to a controller, which may control the method and system by adjusting any number of parameters, for example airflow rate may be adjusted through use of a signal to the air recirculation blower; one or more of flow rate of fuel and/or oxidant may be adjusted via one or more signals, it being understood that suitable transmitters and actuators, such as valves and the like, are not illustrated for clarity.

Methods and systems in accordance with the present disclosure may also comprise one or more oxy-fuel burners, but as they are only used in certain situations, are more likely to be air/fuel burners. In certain embodiments, all combustion burners and burner panels may be oxy/fuel burners or oxy-fuel burner panels (where "oxy" means oxygen, or oxygen-enriched air, as described earlier), but this is not necessarily so in all embodiments; some or all of the combustion burners or burner panels may be air/fuel burners. Furthermore, heating may be supplemented by electrical heating in certain embodiments, in certain zones. Oxy-fuel burners and technologies provide high heat transfer rates, fuel consumption reductions (energy savings), reduced volume of flue gas, and reduction of pollutant emission, such as oxides of nitrogen (NOx), carbon monoxide (CO), and particulates. Despite the reduction of the flue gas volume that the substitution of combustion with air by combustion with pure oxygen or oxygen-enriched air yields, a significant amount of energy is lost in the flue gas (also referred to herein as combustion products, exhaust or exhaust gases), especially for high temperature processes. It would be advantageous to recover some of the energy available from the flue gas in order to improve the economics of operating an oxy-fuel tired oven. One technique consists in using the energy available in the flue gas to preheat and/or dry out the wood raw materials before loading them into the oven. Raw wood has relatively high water content. The energy exchange between the flue gas and the raw materials may be carried out in a preheater. Other methods may use the heat in the flue gases to heat other fluids or materials useful in a wood treatment facility, and then use that heat to preheat raw wood products, or wood chips used in furnaces. Heat transfer fluids may be any gaseous, liquid, slurry, or some combination of gaseous, liquid, and slurry compositions that functions or is capable of being modified to function as a heat transfer fluid. Gaseous heat transfer fluids may be selected from air, including ambient air and treated air (for example, air treated to remove moisture), inorganic gases, such as nitrogen, argon, and helium, organic gases such as fluoro-, chloro- and chlorofluorocarbons, including perfluorinated versions, such as tetrafluoromethane, and hexafluoroethane, and tetrafluoroethylene, and the like, and mixtures of inert gases with small portions of non-inert gases, such as hydrogen. Heat transfer liquids and slurries may be selected from liquids and slurries that may be organic, inorganic, or some combination thereof, for example, water, salt solutions, glycol solutions, oils and the like. Other possible heat transfer fluids include steam (if cooler than the expected glass melt temperature), carbon dioxide, or mixtures thereof with nitrogen. Heat transfer fluids may be compositions comprising both gas and liquid phases, such as the higher chlorofluorocarbons.

In certain methods and systems, control of fuel and/or oxidant may be adjustable with respect to flow of the fuel or oxidant or both. Adjustment may be via automatic, semi-automatic, or manual control.

Certain systems, apparatus, and method embodiments of this disclosure may be controlled by one or more controllers. For example, combustion (flame) temperature may be controlled by monitoring one or more parameters selected from velocity of the fuel, velocity of the primary oxidant, mass and/or volume flow rate of the fuel, mass and/or volume flow rate of the primary oxidant, energy content of the fuel, temperature of the fuel as it enters burners or burner panels, temperature of the primary oxidant as it enters burners or burner panels, temperature of the effluent (exhaust) at the burner exhaust exit, pressure of the primary oxidant entering burners or burner panels, humidity of the oxidant, burner or burner panel geometry, combustion ratio, and combinations thereof. Flow diverter positions may be adjusted or controlled to increase heat transfer in heat transfer substructures and exhaust conduits.

Various conduits, such as fuel and oxidant supply conduits, exhaust conduits, plenums, plates for holding the wood, and airflow ducts of the present disclosure may be comprised of metal, ceramic, ceramic-lined metal, or combination thereof. Suitable metals include carbon steels, stainless steels, for example, but not limited to, 306 and 316 steel, as well as titanium alloys, aluminum alloys, and the like. High-strength materials like C-110 and C-125 metallurgies that are NACE qualified may be employed for burner body components. (As used herein, "NACE" refers to the corrosion prevention organization formerly known as the National Association of Corrosion Engineers, now operating under the name NACE International, Houston, Tex.) Use of high strength steel and other high strength materials may significantly reduce the wall thickness required, reducing weight of the systems and/or space required. In certain locations, precious metals and/or noble metals (or alloys) may be used for portions or all of these conduits. Noble metals and/or other exotic corrosion and/or fatigue-resistant materials such as platinum (Pt), ruthenium (Ru), rhodium (Rh), palladium (Pd), silver (Ag), osmium (Os), iridium (Ir), and gold (Au); alloys of two or more noble metals; and alloys of one or more noble metals with a base metal may be employed. In certain embodiments a protective layer or layers or components may comprise an 80 wt. percent platinum/20 wt. percent rhodium alloy attached to a base metal using brazing, welding or soldering of certain regions.

The choice of a particular material for any component is dictated among other parameters by the chemistry, pressure, and temperature of fuel and oxidant used, wood product being treated and type of product to be produced with certain feedstocks. The skilled artisan, having knowledge of the particular application, pressures, temperatures, and available materials, will be able design the most cost effective, safe, and operable heat transfer substructures, feedstock and exhaust conduits, burners, burner panels, and ovens for each particular application without undue experimentation.

The total quantities of fuel and oxidant used by burners or burner panels of the present disclosure may be such that the flow of oxygen may range from about 0.9 to about 1.2 of the theoretical stoichiometric flow of oxygen necessary to obtain the complete combustion of the fuel flow. Another expression of this statement is that the combustion ratio may range from about 0.9 to about 1.2. The amount of heat needed to be produced by combustion of fuel in the burners (and/or Joule heating) will depend upon the efficiency of any preheating of the feedstock. The larger the amount of heat transferred to the feedstock, the lower the heat energy required in the oven from the fuel and/or Joule elements.

In burners used in the presently disclosed systems and methods, the velocity of the fuel in the various burners and/or burner panel embodiments depends on the burner/burner panel geometry used. The upper limit of fuel velocity depends primarily on the desired temperature of the hot combustion gases and the geometry of the burner; if the fuel velocity is too low, the flame temperature may be too low, providing inadequate temperature in the oven, which is not desired, and if the fuel flow is too high, flame and/or combustion products might impinge on a heat transfer conduit wall, or be wasted, which is also not desired. Similarly, oxidant velocity should be monitored so that flame and/or combustion products do not impinge on heat transfer surfaces, or be wasted. Oxidant velocities depend on fuel flow rate and fuel velocity. Suitable burners include the nozzle-mixing, gas fired, refractory-less burners known under the trade designation TUBE-O-THERM, from MAXON, and may have a heat output ranging from about 0.5 to about 10 million Btu/hr, or from about 0.5 to about 5 million Btu/hr. Such burners are able to burn natural gas, propane, butane, and LPG blends, and incorporate a gas and air valve linked together to control the gas/air ratio over the full throttling range of the burner. Gas flows through the gas nozzle where it mixes with the combustion air.

A combustion and/or Joule heating process control scheme may be employed. A master controller may be employed, but the disclosure is not so limited, as any combination of controllers could be used. The controller may be selected from PI controllers, PID controllers (including any known or reasonably foreseeable variations of these), and may compute a residual equal to a difference between a measured value and a set point to produce an output to one or more control elements. The controller may compute the residual continuously or non-continuously. Other possible implementations of the disclosure are those wherein the controller comprises more specialized control strategies, such as strategies selected from feed forward, cascade control, internal feedback loops, model predictive control, neural networks, and Kalman filtering techniques.

The term "control", used as a transitive verb, means to verify or regulate by comparing with a standard or desired value. Control may be closed loop, feedback, feed-forward, cascade, model predictive, adaptive, heuristic and combinations thereof. The term "controller" means a device at least capable of accepting input from sensors and meters in real time or near-real time, and sending commands directly to burner panel control elements, and/or to local devices associated with burner panel control elements able to accept commands. A controller may also be capable of accepting input from human operators; accessing databases, such as relational databases; sending data to and accessing data in databases, data warehouses or data marts; and sending information to and accepting input from a display device readable by a human. A controller may also interface with or have integrated therewith one or more software application modules, and may supervise interaction between databases and one or more software application modules.

The phrase "PID controller" means a controller using proportional, integral, and derivative features. In some cases the derivative mode may not be used or its influence reduced significantly so that the controller may be deemed a PI controller. It will also be recognized by those of skill in the control art that there are existing variations of PI and PID controllers, depending on how the discretization is performed. These known and foreseeable variations of PI, PID and other controllers are considered within the disclosure.

The controller may utilize Model Predictive Control (MPC). MPC is an advanced multivariable control method for use in multiple input/multiple output (MIMO) systems. MPC computes a sequence of manipulated variable adjustments in order to optimise the future behavior of the process in question. It may be difficult to explicitly state stability of an MPC control scheme, and in certain embodiments of the present disclosure it may be necessary to use nonlinear MPC. In so-called advanced control of various systems, PID control may be used on strong mono-variable loops with few or nonproblematic interactions, while one or more networks of MPC might be used, or other multivariable control structures, for strong interconnected loops. Furthermore, computing time considerations may be a limiting factor. Some embodiments may employ nonlinear MPC.

A feed forward algorithm, if used, will in the most general sense be task specific, meaning that it will be specially designed to the task it is designed to solve. This specific design might be difficult to design, but a lot is gained by using a more general algorithm, such as a first or second order filter with a given gain and time constants.

Although only a few exemplary embodiments of this disclosure have been described in detail above, those skilled in the art will readily appreciate that many modifications are possible in the exemplary embodiments without materially departing from the novel teachings and advantages of this disclosure. Accordingly, all such modifications are intended to be included within the scope of this disclosure as defined in the following claims. In the claims, no clauses are intended to be in the means-plus-function format allowed by 35 U.S.C. §112, Section F, unless "means for" is explicitly recited together with an associated function. "Means for" clauses are intended to cover the structures, materials, and/or acts described herein as performing the recited function and not only structural equivalents, but also equivalent structures.

What is claimed is:

1. A method comprising:

(a) loading a batch of wood or lumber into a wood treating zone of a structure having a longitudinal axis, the structure defining the wood treating zone, an air heating zone, a heated air supply zone, and a cooled air return zone, the wood treating zone fluidly connected to the heated air supply zone and the cooled air return zone, and the air heating zone fluidly connected to the cooled air return zone and the heated air supply zone, the batch of wood or lumber comprising a stack of a plurality of rows of horizontal wood members, each row comprising top and bottom metal plates sandwiching at least one wood member there between, each row separated from adjacent rows by respective air gaps;

(b) forming an indirectly heated air stream by indirectly exchanging heat in the air heating zone from hot air or hot combustion products to a combined cooled air stream flowing through the air heating zone by contacting the hot air or hot combustion products with one side of one or more heat transfer surfaces with the cooled air stream contacting part or all of opposite sides of the one or more heat transfer surfaces;

(c) splitting the indirectly heated air stream into right-side and a left-side indirectly heated air streams;

(d) flowing the right-side indirectly heated air stream into a right plenum, and flowing the left-side indirectly heated air stream into a left plenum, the right and left plenums positioned aside respective right and left sides of the stack in the heated air supply zone;

(e) flowing the right-side and left-side indirectly heated air streams from their respective plenums generally horizontally between the rows in the wood treating zone, the respective indirectly heated air streams flowing into the air gaps simultaneously from right and left plenums causing turbulence in the air gaps, and then exiting to forward and rear of the wood treatment zone and forming front and rear cooled air streams; and (f) collecting a major portion of the front and rear cooled air streams above the stack in a return duct of the cooled air return zone forming the combined cooled air stream, and flowing the combined cooled air stream to the air heating zone.

2. The method of claim 1 wherein the indirectly exchanging heat in the air heating zone comprises exchanging heat from hot combustion products from one or more combustion burners flowing through one or more heated tubular members to the combined cooled air stream flowing through the air heating zone, the hot combustion products formed by combusting one or more fuels with one or more oxidants in the one or more combustion burners attached to the structure externally of the air heating zone, one or more burner exhaust conduits fluidly connected at a first end to the one or more combustion burners and at a second end to a roof of the structure, the one or more exhaust conduits defining the heated tubular members arranged in an indirect heat exchange substructure in the air heating zone.

3. The method of claim 1 wherein the loading comprises moving a removable cart or carriage loaded with the stack of wood or lumber into the wood treating zone, the removable cart or carriage and load of wood thereon closely fitting within the wood treating zone but not touching the left and right plenums or the return duct.

4. The method of claim 1 comprising exhausting a minor portion of the combined cooled air stream from the cooled air return zone.

5. The method of claim 1 wherein the directing of the combined cooled air stream past the one or more heated tubular members in the air heating zone comprises flowing the combined cooled air stream in cross-flow pattern across outer surfaces of the heated tubular members.

6. The method of claim 5 wherein the combined cooled air stream flows generally downward while passing across the outer surfaces of the heated tubular members.

7. The method of claim 2 wherein the fuel is selected from the group consisting of methane, gaseous natural gas, liquefied natural gas, propane, butane, hydrogen, steam-reformed natural gas, atomized hydrocarbon oil, combustible powders, flowable solids, waste materials, slurries, and mixtures or other combinations thereof, and the oxidant is selected from the group consisting of air, gases having the same molar concentration of oxygen as air, oxygen-enriched air having 50 mole percent or more oxygen, industrial grade oxygen, food grade oxygen, and cryogenic oxygen.

8. The method of claim 1 wherein the cooled air is heated to a temperature ranging from about 150° F. to about 800° F. (66° C. to about 427° C.).

9. The method of claim 1 comprising controlling moisture removal from the wood or lumber by one or more control methods selected from the group consisting of monitoring humidity of the front, rear, or combined cooled air stream, monitoring humidity of the indirectly heated air stream, monitoring one or more temperatures of the front, rear, or combined cooled air steams and/or heated air streams, and combinations thereof.

10. The method of claim 1 wherein the wood or lumber is selected from the group consisting of natural woods, composites, and laminates.

11. The method of claim 10 wherein the natural wood is selected from the group consisting of pine, spruce, hardwoods, and sustainable wood species.

12. A system comprising:

(a) a structure having a longitudinal axis, the structure defining a wood treating zone, an air heating zone, a heated air supply zone, and a cooled air return zone;

(b) one or more combustion burners attached to the structure externally of the air heating zone and comprise a right-side burner and a left-side burner attached respectively to opposing left and right walls of the structure;

(c) one or more conduits fluidly connected at a first end to the one or more heating units and at a second end to a roof of the structure, the one or more conduits defining one or more heat transfer surfaces and an indirect heat exchange substructure in the air heating zone, the one or more heat transfer surfaces are one or more burner exhaust conduits defining tubular members of the indirect heat exchange substructure in the air heating zone and are arranged at angles ranging from 0 to 45 degrees to horizontal in a cross-flow pattern, the horizontally arranged tubular members fluidly connected by U-shaped return members;

(d) the heated air supply zone comprising left and right heated air plenums, and the cooled air return zone comprising a return duct, the plenums and return duct internal of the wood treating zone;

(e) a movable cart or carriage configured for moving spaced apart stacked wood products to be treated into and out of the wood heating zone, the removable cart or carriage and, when loaded, load of wood thereon closely fitting within the wood treating zone but not touching the left and right plenums or the return duct; and (f) at least one recirculating air blower internal of the heated air supply zone and in fluid communication with the air heating zone and the heated air supply zone, and at least one exhaust blower in fluid communication with the cooled air return zone.

13. The system in accordance with claim 12 wherein the wood treating zone is fluidly connected to the heated air supply zone and the cooled air return zone, and the air heating zone is fluidly connected to the cooled air return zone and the heated air supply zone, the batch of wood or lumber comprising a stack of a plurality of rows of horizontal wood members, each row comprising top and bottom metal plates sandwiching at least one wood member there between, each row separated from adjacent rows by respective air gaps.

14. The system in accordance with claim 12 wherein the left and right heated air plenums are configured vertically and co-extensively with the respective left and right edges of the stack of wood, and parallel to the longitudinal axis of the structure, each plenum having a constant cross-sectional area, each plenum fluidly connected to respective left and right outlet ducts of a single recirculating air blower, the left and right outlet ducts each having a cross-sectional area greater than the cross-sectional area of the plenums.

15. The system in accordance with claim 12 wherein the left and right heated air plenums comprise a plurality of vertical sheet metal panels and a plurality of vertical sheet metal nozzles adjustably attached between respective vertical sheet metal panels using a plurality of threaded members, the vertical nozzles adjustable in forward and rear directions depending on adjustment in and out of the plurality of threaded members.

16. The system in accordance with claim 12 wherein the combustion burners are nozzle-mixing, gas fired, refractoryless burners.

17. The system in accordance with claim 12 wherein the heat exchange substructure comprises one or more internal structures for causing a tortuous flow path for the cooled air stream.

18. A system comprising:

(a) a structure having a longitudinal axis, the structure defining a wood treating zone, an air heating zone, a heated air supply zone, and a cooled air return zone;

(b) one or more combustion burners attached to the structure externally of the air heating zone;

(c) one or more burner exhaust conduits fluidly connected at a first end to the one or more combustion burners and at a second end to a roof of the structure, the one or more burner exhaust conduits defining one or more heated tubular members and an indirect heat exchange substructure in the air heating zone;

(d) the heated air supply zone comprising left and right heated air plenums, and the cooled air return zone comprising a return duct, the plenums and return duct internal of the wood treating zone, wherein the left and right heated air plenums comprise a plurality of vertical sheet metal panels and a plurality of vertical sheet metal nozzles adjustably attached between respective vertical sheet metal panels using a plurality of threaded members, the vertical nozzles adjustable in forward and rear directions depending on adjustment in and out of the plurality of threaded members; and (e) at least one recirculating air blower internal of the heated air supply zone and in fluid communication with the air heating zone and the heated air supply zone, and at least one exhaust blower in fluid communication with the cooled air return zone.

19. The system in accordance with claim 18 comprising a movable cart or carriage for moving a batch of spaced apart stacked wood products to be treated into and out of the wood heating zone, the removable cart or carriage and load of wood thereon closely fitting within the wood treating zone but not touching the left and right plenums or the return duct.

20. The system in accordance with claim 19 wherein the batch of wood products comprises a stack of a plurality of rows of horizontal wood members, each row comprising top and bottom metal plates sandwiching at least one wood member there between, each row separated from adjacent rows by respective air gaps.

21. A movable cart or carriage for moving spaced apart stacked wood products to be treated into and out of a wood heating zone of a structure, the removable cart or carriage configured to closely fitting within the wood treating zone but not touching structure of the wood treating zone, the movable cart or carriage comprising:

(a) a frame comprising a floor, four vertical corner supports attached at their lower end to respective corners of the floor and extending upward and connecting at their upper ends to frame cross members;

(b) a stack of a plurality of rows adapted to hold a plurality of horizontal wood members, each row comprising top and bottom metal plates sandwiching at least one wood member there between, each row separated from adjacent rows by respective air gaps, the rows connected on their periphery by rods and nuts allowing the top metal plate of each row to be lifted and separated from the bottom metal plate, allowing loading of the cart;

(c) a plurality of tubular members adapted to separate the rows and define a plurality of separate levels for the wood panels, the tubular members movable with respect to each other in a vertical direction as the top plate of each row is lifted and dropped during cart loading, and when the wood panels lose or gain moisture during heat treatment;

(d) one or more winches attached to the cart or carriage frame and to one or more sets of the tubular members, the one or more winches adapted to compress the frame vertically as the wood panels lose moisture, or loosen the frame as the wood panels gain moisture.

22. The movable cart or carriage of claim 21 comprising a set of frame support members selected from the group consisting of wheels, rollers, bearings, skates, and sets of magnets for magnetic levitation.

23. The movable cart or carriage of claim 22, wherein the wheels are configured to interact with corresponding rails.

24. A system for treating wood comprising the movable cart or carriage of claim 21.

25. A system for treating wood comprising the movable cart or carriage of claim 22.

26. A system for treating wood comprising the movable cart or carriage of claim 23.

27. A wood product or composite made by the process of claim 1.

* * * * *